US009595411B2

(12) United States Patent
Shimizu et al.

(10) Patent No.: US 9,595,411 B2
(45) Date of Patent: Mar. 14, 2017

(54) ELECTROMAGNETIC RELAY

(71) Applicant: Panasonic Intellectual Property Management Co., Ltd., Osaka (JP)

(72) Inventors: Yosuke Shimizu, Mie (JP); Masakazu Kobayashi, Osaka (JP); Shinya Kimoto, Osaka (JP); Riichi Uotome, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/906,891

(22) PCT Filed: Jul. 23, 2014

(86) PCT No.: PCT/JP2014/003864
§ 371 (c)(1),
(2) Date: Jan. 21, 2016

(87) PCT Pub. No.: WO2015/015761
PCT Pub. Date: Feb. 5, 2015

(65) Prior Publication Data

US 2016/0181038 A1 Jun. 23, 2016

(30) Foreign Application Priority Data

Aug. 2, 2013 (JP) ..... 2013-161072
May 29, 2014 (JP) ..... 2014-111586

(51) Int. Cl.
*H01H 75/00* (2006.01)
*H01H 77/00* (2006.01)
(Continued)

(52) U.S. Cl.
CPC ..... *H01H 50/36* (2013.01); *H01H 1/54* (2013.01); *H01H 50/16* (2013.01); *H01H 50/18* (2013.01);
(Continued)

(58) Field of Classification Search
CPC ..... H01H 77/107
(Continued)

(56) References Cited

U.S. PATENT DOCUMENTS 1,204,485 A * 11/1916 Randall ..... H01H 71/123 361/115
4,292,611 A * 9/1981 Bresson ..... H01H 3/222 335/147
(Continued)

FOREIGN PATENT DOCUMENTS

| | | |
|---|---|---|
| DE | 474087 C | 3/1929 |
| JP | 57-163939 | 10/1982 |
| JP | 4-087130 | 3/1992 |

OTHER PUBLICATIONS

International Search Report of PCT application No. PCT/JP2014/003864 dated Aug. 19, 2014.

*Primary Examiner* — Alexander Talpalatski
(74) *Attorney, Agent, or Firm* — McDermott Will & Emery LLP

(57) ABSTRACT

An electromagnetic relay includes an electromagnet device, a contact device, and a trip device. The electromagnet device includes a first stator, a movable element, and a first exciting coil. The contact device includes a movable contact and a fixed contact. A trip device includes a second exciting coil. The electromagnet device moves the movable element from a first position to a second position. The trip device moves the movable element to a third position. An open state is reached when the movable element is in the first position and
(Continued)

the third position. A closed state is reached when the movable element is in the movable element is in the second position.

27 Claims, 21 Drawing Sheets

(51) Int. Cl.

| | |
|---|---|
| ***H01H 50/36*** | (2006.01) |
| ***H01H 50/44*** | (2006.01) |
| ***H01H 50/42*** | (2006.01) |
| ***H01H 51/06*** | (2006.01) |
| ***H01H 71/26*** | (2006.01) |
| ***H01H 1/54*** | (2006.01) |
| ***H01H 50/16*** | (2006.01) |
| ***H01H 50/54*** | (2006.01) |
| ***H01H 50/18*** | (2006.01) |
| ***H01H 50/56*** | (2006.01) |
| ***H01H 50/60*** | (2006.01) |
| *H01H 3/00* | (2006.01) |

(52) U.S. Cl.
CPC ..... *H01H 50/42* (2013.01); *H01H 50/44* (2013.01); *H01H 50/54* (2013.01); *H01H 50/56* (2013.01); *H01H 50/60* (2013.01); *H01H 51/065* (2013.01); *H01H 71/26* (2013.01); *H01H 3/001* (2013.01); *H01H 2235/01* (2013.01)

(58) Field of Classification Search
USPC ..... 335/131, 92, 6, 136, 15–16
See application file for complete search history.

(56) References Cited

U.S. PATENT DOCUMENTS 5,986,528 A * 11/1999 Meier ..... H01H 1/54 335/129
6,150,909 A * 11/2000 Meier ..... H01H 71/2409 335/129
8,860,537 B2 * 10/2014 Sora ..... H01F 7/1607 335/126

* cited by examiner

ELECTROMAGNETIC RELAY

This application is a U.S. national stage application of the PCT international application No. PCT/JP2014/003864.

TECHNICAL FIELD

The present technology relates to an electromagnetic relay opening and closing a contact device by an electromagnet device.

BACKGROUND ART

FIG. 23 is a sectional schematic view of a conventional electromagnetic relay (electromagnet relay) 500. Electromagnetic relay 500 includes electromagnet device 530 and contact device 520. Electromagnet device 530 includes coil 502, movable element 503 (plunger), permanent magnet 505, and overcurrent detection coil 513. Coil 502 attracts and drives movable element 503. Permanent magnet 505 is disposed facing movable element 503. Contact device 520 for attracting and holding movable element 503 includes fixed contact 510, movable contact 511, and contact spring 512.

When a voltage is applied to coil 502, movable element 503 is attracted by permanent magnet 505. Thereby, fixed contact 510 and movable contact 511 are brought into contact with each other, and contact device 520 is turned on. Then, even after excitation of coil 502 is released, movable element 503 is held by magnetic flux of permanent magnet 505, and contact device 520 is continued to be on.

When an abnormal current such as an overcurrent and a short-circuit current flows into contact device 520, movable element 503 is driven by overcurrent detection coil 513 in a reverse direction to permanent magnet 505, and contact device 520 is turned off. Thus, electromagnetic relay 500 forcibly restores movable element 503 by using magnetic flux generated when an abnormal current flows. That is to say, electromagnetic relay 500 can detect generation of an abnormal current and disconnect an electric circuit. As prior art literatures of the above-mentioned conventional technology, for example, PTL 1 is well known.

CITATION LIST

Patent Literature

Patent Literature 1: Japanese Patent Application Unexamined Publication No. S57-163939

SUMMARY OF THE INVENTION

An electromagnetic relay includes an electromagnet device, a contact device, and a trip device.

The electromagnet device includes a first stator, a movable element, and a first exciting coil. The movable element is disposed facing the first stator. The first exciting coil is wound around at least a part of the first stator. When the first exciting coil is energized, the electromagnet device attracts the movable element to the first stator by first magnetic flux generated by the first exciting coil, and moves the movable element from a first position to a second position.

The contact device includes a movable contact and a fixed contact. The movable contact is disposed on the opposite side to the movable element with respect to the first stator, and linked to the movable element. The fixed contact is disposed facing the movable contact.

A trip device includes a second exciting coil, and is disposed on the opposite side to the contact device with respect to the electromagnet device. The second exciting coil is coupled to the contact device. The trip device moves the movable element to a third position by a second magnetic flux generated by the second exciting coil when not less than a prescribed value of electric current flows in the contact device in a state in which the movable element is in the second position.

When the movable element is in the first position and the third position, the movable contact and the fixed contact are away from each other to form an open state. When the movable element is in the second position, the movable contact and the fixed contact are brought into contact with each other to form a closed state.

DESCRIPTION OF EMBODIMENTS

Figure 1:
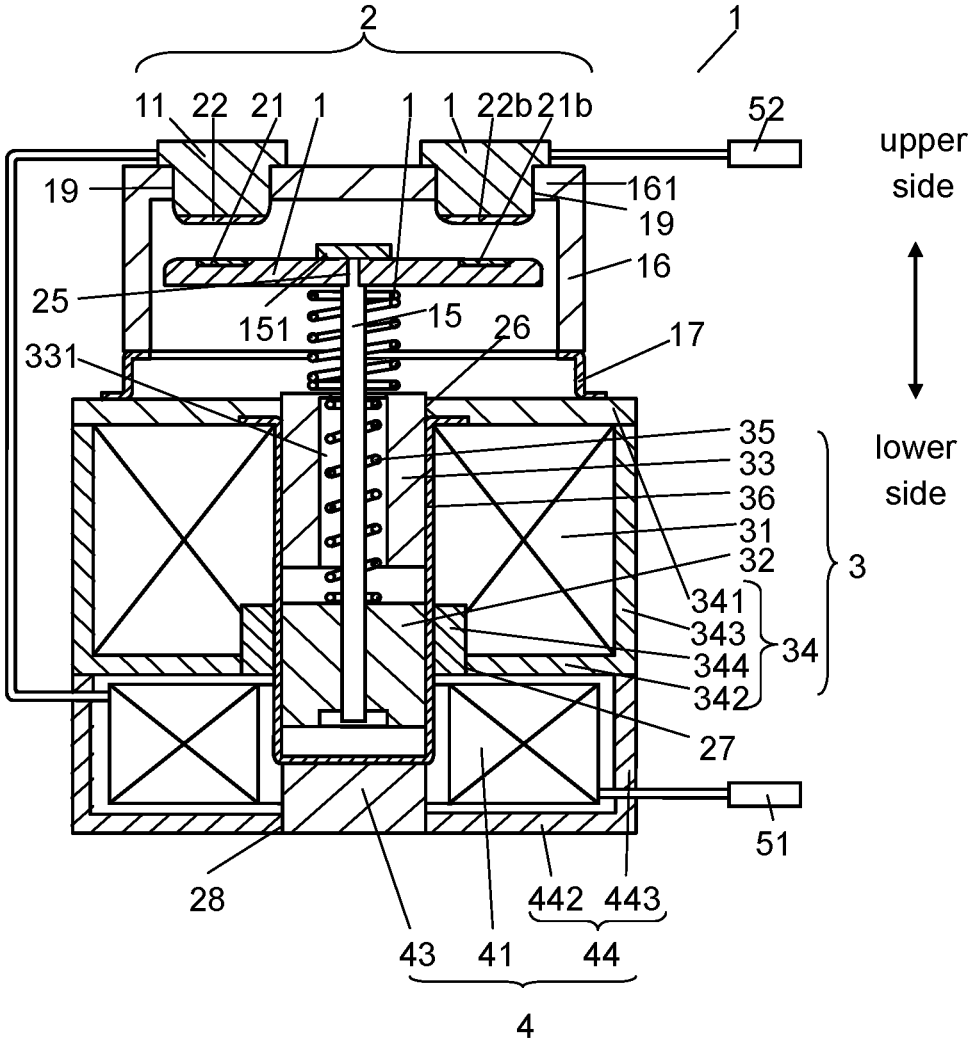
FIG. 1 is a sectional schematic view of an electromagnetic relay in accordance with a first exemplary embodiment.

A conventional electromagnetic relay 500 needs space for disposing overcurrent detection coil 513 between coil 502 and contact device 520. Furthermore, in conventional electromagnetic relay 500, movable element 503 is attracted by magnetic flux generated by overcurrent detection coil 513. However, since overcurrent detection coil 513 is disposed between coil 502 and contact spring 512, a structure of movable element 503 is restricted. Therefore, it is necessary to form a component such as movable element 503 into a special shape. That is to say, in conventional electromagnetic relay 500, it is necessary to specially design a component such as movable element 503 to turn off contact device 520 when an abnormal current such as an overcurrent and a short-circuit current flows into contact device 520. Thus, when overcurrent detection coil 513 is disposed, it is difficult to share components with a movable element and the like when overcurrent detection coil 513 is not provided.

First Exemplary Embodiment

Figure 2:
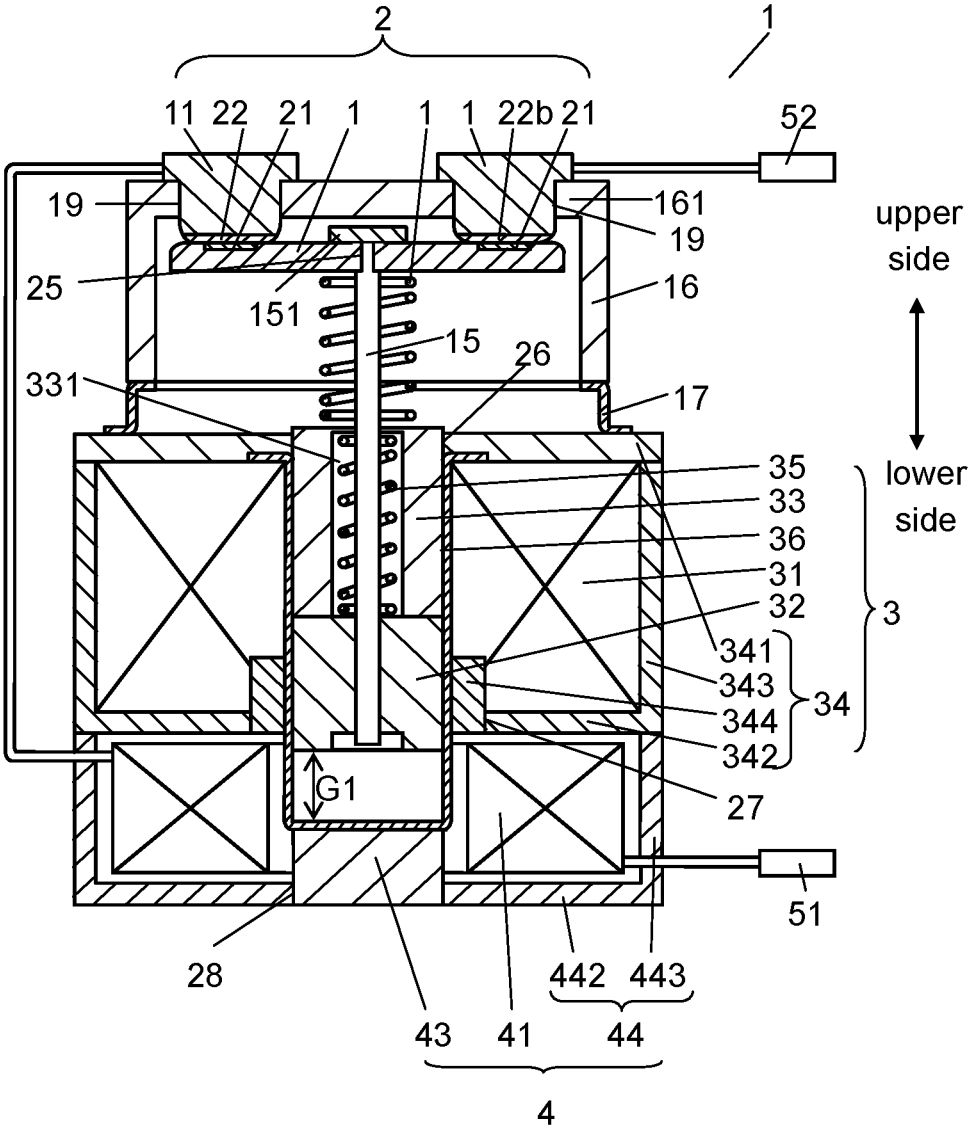
FIG. 2 is a sectional schematic view of the electromagnetic relay in accordance with the first exemplary embodiment.
Figure 3:
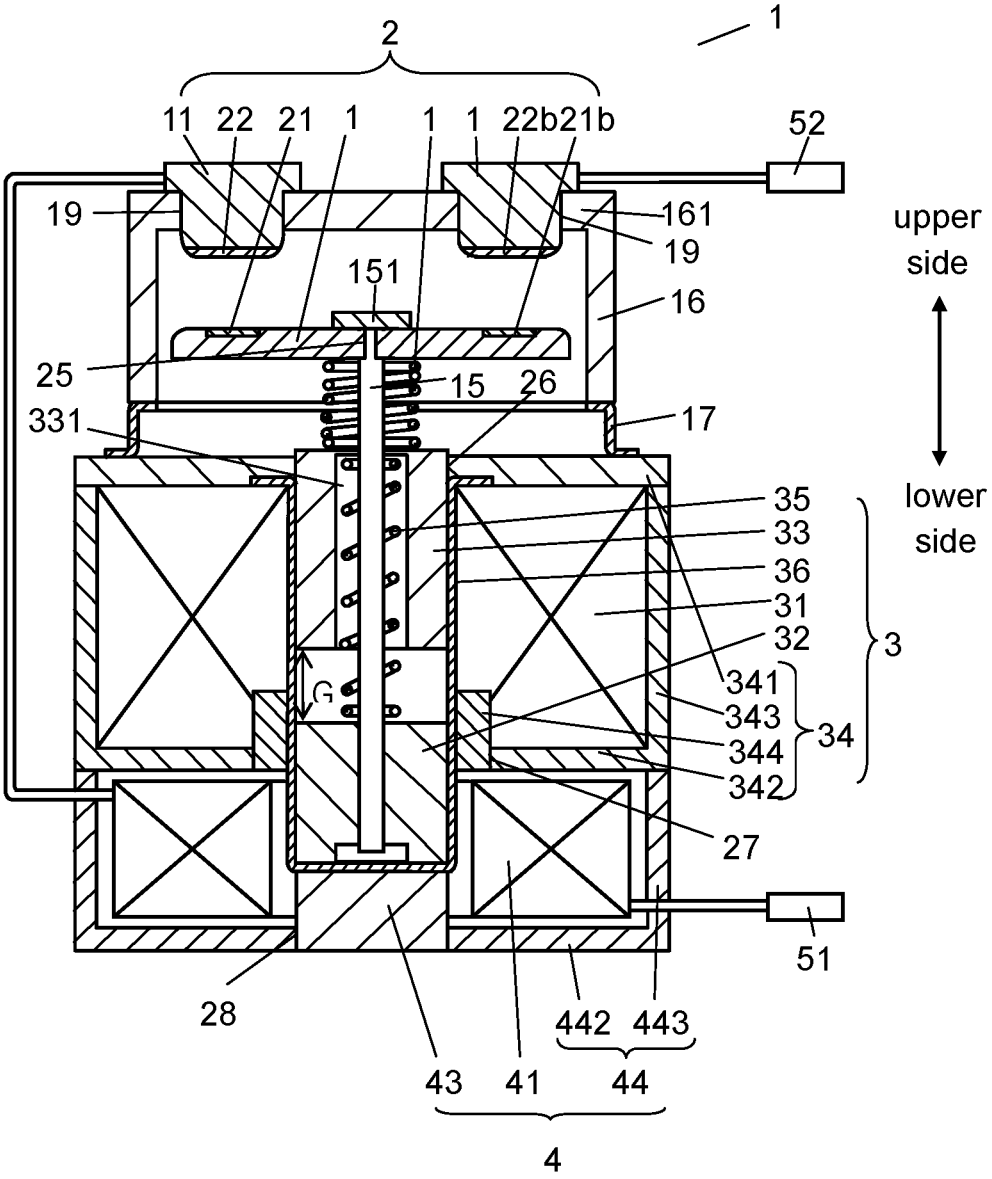
FIG. 3 is a sectional schematic view of the electromagnetic relay in accordance with the first exemplary embodiment.
Figure 4:
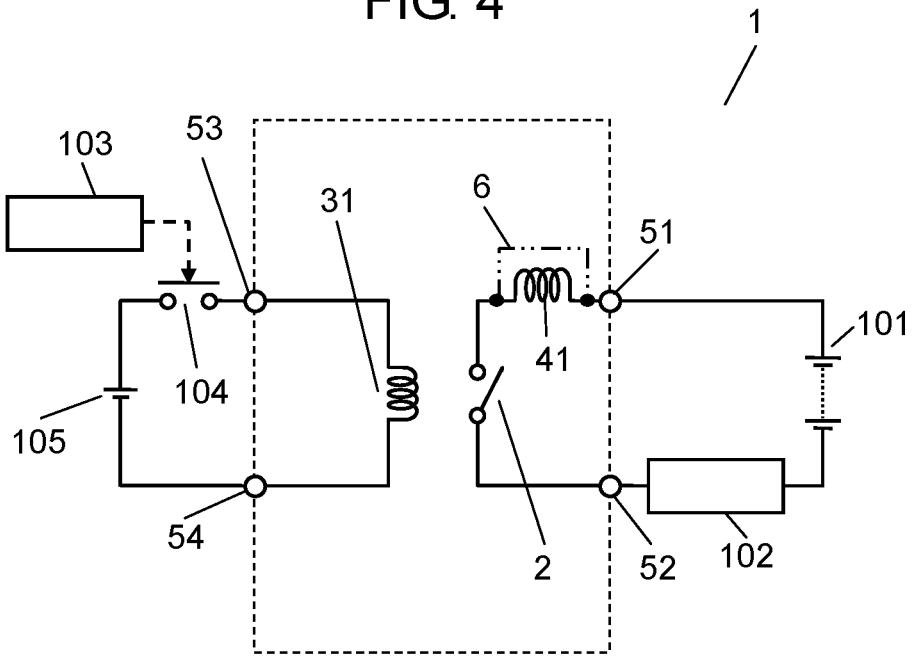
FIG. 4 is a diagram showing a circuit configuration of the electromagnetic relay in accordance with the first exemplary embodiment.

FIGS. 1 to 3 are sectional schematic views of electromagnetic relay 1 in accordance with this exemplary embodiment. FIG. 4 is a diagram showing a circuit configuration of electromagnetic relay 1 in accordance with this exemplary embodiment. FIG. 1 shows electromagnetic relay 1 when movable element 32 is in a first position. FIG. 2 shows electromagnetic relay 1 when movable element 32 is in a second position. FIG. 3 shows electromagnetic relay 1 when movable element 32 is in a third position. When first exciting coil 31 is not energized, movable element 32 is in the first position. Thereafter, when first exciting coil 31 is energized, movable element 32 moves to the second position. When an abnormal current flows in second exciting coil 41, movable element 32 moves to the third position.

Electromagnetic relay 1 includes electromagnet device 3, contact device 2, and trip device 4.

Electromagnet device 3 includes first stator 33, movable element 32, and first exciting coil 31. Movable element 32 is disposed facing first stator 33. First exciting coil 31 is wound around at least a part of first stator 33. At the time of energization of the first exciting coil, electromagnet device 3 attracts movable element 32 to first stator 33 by first magnetic flux generated by first exciting coil 31, and moves movable element 32 from the first position to the second position.

Contact device 2 includes movable contacts 21*a* and 21*b* and fixed contacts 22*a* and 22*b*. Movable contacts 21*a* and 21*b* are disposed on the opposite side to movable element 32 with respect to first stator 33, and linked to movable element 32. Fixed contacts 22*a* and 22*b* are disposed facing movable contacts 21*a* and 21*b*.

Trip device 4 includes second exciting coil 41, and is disposed on the opposite side to contact device 2 with respect to electromagnet device 3. Second exciting coil 41 is coupled to contact device 2. Trip device 4 moves movable element 32 to a third position by a second magnetic flux generated by second exciting coil 41 when not less than a prescribed value of electric current flows in contact device 2 in a state in which movable element 32 is in the second position.

When movable element 32 is in the first position and the third position, movable contacts 21*a* and 21*b* and fixed contacts 22*a* and 22*b* are away from each other to form an open state. When movable element 32 is in the second position, movable contacts 21*a* and 21*b* and fixed contacts 22*a* and 22*b* are brought into contact with each other to form a closed state.

Herein, it is preferable that trip device 4 further includes second stator 43 disposed on the opposite side to first stator 33 with respect to movable element 32. In this case, movable element 32 is attracted to second stator 43 by the magnetic flux generated due to an abnormal current in second exciting coil 41.

Hereinafter, electromagnetic relay 1 of this exemplary embodiment is described. However, electromagnetic relay 1 described below is just an example of the present invention. The present invention is not limited to the following exemplary embodiments and may include other exemplary embodiments. Various modifications can be made depending on designs and the like without departing from the scope of the technical idea in accordance with the present invention.

Electromagnetic relay 1 includes contact device 2, electromagnet device 3, and trip device 4. Furthermore, electromagnetic relay 1 may include shaft 15, case 16, and connector 17. In addition, electromagnetic relay 1 may include first output terminal 51 and second output terminal 52 on a power supply path of direct-current power from travelling battery 101 to load 102, and input terminals 53 and 54 connected to excitation power source 105 (see FIG. 4).

Contact device 2, electromagnet device 3, and trip device 4 are disposed in one direction (on the same straight line). Trip device 4 is disposed on the opposite side to contact device 2 with respect to electromagnet device 3.

In this exemplary embodiment, electromagnetic relay 1 is mounted on electric vehicle (EV). As shown in FIG. 4, contact device 2 is disposed on the power supply path of the direct-current power from travelling battery 101 to load 102 (for example, an inverter). First exciting coil 31 of electromagnetic relay 1 is coupled to excitation power source 105 via switching element 104 switched between on and off in response to a control signal from electronic control unit (ECU) 103 of the electric vehicle. Thus, in response to the control signal from electronic control unit 103, contact device 2 is opened or closed, and the supply state of the direct-current power from travelling battery 101 to load 102 is switched.

Next, electromagnet device 3 is described. Electromagnet device 3 includes first exciting coil 31, movable element 32, and first stator 33. Furthermore, electromagnet device 3 may include first yoke 34, return spring 35, and cylindrical body 36. In addition, electromagnet device 3 may include a coil bobbin (not shown) which is made of synthetic resin and around which first exciting coil 31 is wound.

Movable element 32 is attracted to first stator 33 by magnetic flux generated by first exciting coil 31 when first exciting coil 31 is energized, and movable element 32 moves from the first position shown in FIG. 1 to the second position shown in FIG. 2.

First yoke 34 includes yoke upper plate 341, yoke lower plate 342, yoke lateral plate 343, and bush 344. Yoke upper plate 341, yoke lower plate 342, yoke lateral plate 343, and bush 344 are formed of magnetic material. That is to say, first yoke 34 is formed of magnetic material. Furthermore, first stator 33 and movable element 32 are also formed of magnetic material. Consequently, first yoke 34, together with first stator 33 and movable element 32, forms a magnetic path (first magnetic path) through which the magnetic flux generated at the time of energization of first exciting coil 31 passes (detail thereof is described later with reference to FIGS. 7A and 7B).

Yoke upper plate 341 and yoke lower plate 342 are provided on both sides of first exciting coil 31 and face each other. In the side cross-section of electromagnetic relay 1 shown in FIG. 1, a yoke upper plate 341 side seen from first exciting coil 31 is defined as an upper direction, and a yoke lower plate 342 side seen from first exciting coil 31 is defined as a lower direction. In other words, in the side cross-section of electromagnetic relay 1 shown in FIG. 1, contact device 2 is disposed above electromagnet device 3, and trip device 4 is disposed below electromagnet device 3. However, it should not be construed that this description restricts the use mode of electromagnetic relay 1.

Yoke lateral plate 343 links the peripheral edge of yoke upper plate 341 and the peripheral edge of yoke lower plate 342 to each other. Bush 344 is formed in a cylindrical shape protruding upward from the center portion of the upper surface of yoke lower plate 342. Each of yoke upper plate 341 and yoke lower plate 342 is formed in a rectangular shape. These yoke lateral plate 343 and yoke lower plate 342 are formed continuously and unitarily from one plate. Holding hole 27 is formed in the center portion of yoke lower plate 342. The lower end part of bush 344 is fitted into holding hole 27 of yoke lower plate 342.

First exciting coil 31 is disposed in space surrounded by yoke upper plate 341, yoke lower plate 342 and yoke lateral plate 343. Then, bush 344, first stator 33, and movable element 32 are disposed in the inner side of first exciting coil 31. Both ends of first exciting coil 31 are connected to input terminals 53 and 54, respectively (see FIG. 4).

First stator 33 is a cylindrical fixed iron core, and protrudes downward from the center portion of yoke upper plate 341. The upper end part of first stator 33 is fixed to yoke upper plate 341 of first yoke 34. Specifically, fitting hole 26 is formed in the center portion of yoke upper plate 341. The upper end part of first stator 33 is fitted into fitting hole 26 of yoke upper plate 341. The outer diameter of first stator 33 is formed to be smaller than the inner diameter of bush 344. Furthermore, a clearance (gap) is formed between the lower end surface of first stator 33 and the upper end surface of bush 344 in the vertical direction.

Movable element 32 is a columnar movable iron core, and is disposed such that the upper end surface thereof faces the lower end surface of first stator 33. The outer diameter of movable element 32 is formed to be equal to the outer diameter of first stator 33 and smaller than the inner diameter of bush 344. Movable element 32 moves in the vertical direction along the inner peripheral surface of bush 344. In other words, movable element 32 moves between the first position in which the upper end surface of movable element 32 is away from the lower end surface of first stator 33 (see FIG. 1), and the second position in which the upper end surface of movable element 32 is brought into contact with the lower end surface of first stator 33 (see FIG. 2). Note here that in this exemplary embodiment, movable element 32 can move to the third position (see FIG. 3) further downward from the first position. This point is described later.

Return spring 35 is disposed in the inner side of first stator 33, and it is a coil spring urging movable element 32 downward (to the first position). Housing space 331 for housing return spring 35 is formed in the inner side of first stator 33. When movable element 32 is attracted to first stator 33 and moves from the first position to the second position, return spring 35 is housed in housing space 331 while it is compressed. Consequently, movable element 32 can be brought into contact with first stator 33.

Cylindrical body 36 is formed of non-magnetic material having a bottomed cylindrical shape with a top surface opened. Cylindrical body 36 houses first stator 33 and movable element 32. The upper end part (peripheral edge of the opening part) of cylindrical body 36 is fixed to yoke upper plate 341, and the lower part of cylindrical body 36 is fitted into the inner side of bush 344. A distance from the bottom surface of cylindrical body 36 to the lower end surface of first stator 33 is sufficiently larger than the dimension in the vertical direction of movable element 32. That is to say, cylindrical body 36 is set such that a clearance is generated between the lower end surface of movable element 32 and the bottom surface of cylindrical body 36 in a state in which movable element 32 is away from first stator 33, that is, in the first position.

With the above-mentioned configuration, movable element 32 can move inside cylindrical body 36 from the second position in which movable element 32 is brought into contact with first stator 33 to the third position by way of the first position. When movable element 32 is in the second position, gap G1 (see FIG. 2) is generated between the lower end surface of movable element 32 and the bottom surface of cylindrical body 36. Furthermore, when movable element 32 is in the third position, gap G2 (see FIG. 3) is generated between the upper end surface of movable element 32 and the lower end surface of first stator 33. Cylindrical body 36 restricts the moving direction of movable element 32 in the vertical direction, and defines the third position of movable element 32.

Note here that the central axes of first exciting coil 31, bush 344, first stator 33, and movable element 32 are located in the same line along the vertical direction.

When first exciting coil 31 is not energized (at the time of non-energization), since a magnetic attractive force is not generated between movable element 32 and first stator 33, movable element 32 is located in the first position by a spring force of return spring 35 (see FIG. 1). On the other hand, when first exciting coil 31 is energized, since a magnetic attractive force is generated between movable element 32 and first stator 33, movable element 32 is attracted against the spring force of return spring 35 and moves to the second position (see FIG. 2).

In other words, at the time of energization of first exciting coil 31, first exciting coil 31 generates magnetic flux in a magnetic path (first magnetic path) formed by first yoke 34, first stator 33, and movable element 32. Movable element 32 moves so as to reduce magnetic resistance of this magnetic path. Specifically, at the time of energization of first exciting coil 31, movable element 32 moves from the first position to the second position so as to fill a gap between the lower end surface of first stator 33 and the upper end surface of bush 344 with movable element 32.

In short, movable element 32 is attracted to first stator 33 by the magnetic flux generated by first exciting coil 31 at the time of energization of first exciting coil 31, and movable element 32 moves from the first position to the second position. Then, while the energization of first exciting coil 31 continues, since an attractive force continues to be generated between first stator 33 and movable element 32, movable element 32 is held in the second position. Furthermore, when the energization of first exciting coil 31 is stopped, movable element 32 moves from the second position to the first position by the spring force of return spring 35. Thus, in response to switching of the energization states of first exciting coil 31, an attractive force acting on movable element 32 is controlled. As a result, movement of movable element 32 in the vertical direction switches the states of contact device 2 between an open state and a closed state.

Herein, at the time of non-energization of first exciting coil 31, movable element 32 is located not in the third position that is the bottom end of the moving range (see FIG. 3) but in the first position that is an intermediate position of the moving range (see FIG. 1) is because the spring force of return spring 35 and the spring force of contact pressure spring 14 balanced with each other. That is to say, the spring force of return spring 35 acts downwardly on movable element 32, and the spring force of contact pressure spring 14 acts upwardly via movable contactor 13 and shaft 15. Consequently, at the time of non-energization of first exciting coil 31, movable element 32 stops in the first position in which a force acting from return spring 35 on movable element 32 and a force acting from contact pressure spring 14 on movable element 32 are balanced with each other.

At the time of non-energization of first exciting coil 31, movable element 32 of electromagnet device 3 is located in the first position that is an intermediate position between the second position and the third position. Therefore, shaft 15 is drawn downward by electromagnet device 3. At this time, shaft 15 pushes movable contactor 13 downward by flange 151 provided at the upper end part of shaft 15. Since upward movement of movable contactor 13 is restricted by flange 151 of shaft 15, movable contacts 21*a* and 21*b* are in the open position and are away from fixed contacts 22*a* and 22*b*. In this state, since contact device 2 is in an open state, contact bases 11 and 12 are not conducting with each other, and first output terminal 51 and second output terminal 52 are not conducting with each other.

Although details are described later, as shown in FIG. 3, also when movable element 32 of electromagnet device 3 is in the third position, similar to the case in the first position, shaft 15 is drawn downward by electromagnet device 3. Therefore, movable contactor 13 allows movable contacts 21*a* and 21*b* to be located in an open position away from fixed contacts 22*a* and 22*b*, so that contact device 2 is opened.

FIG. 2 shows a state of electromagnetic relay 1 when first exciting coil 31 is energized. In this state, since movable element 32 of electromagnet device 3 is located in the second position, shaft 15 is pushed up by electromagnet device 3. Accordingly, flange 151 provided in the upper end part of shaft 15 moves upward. As a result, restriction to movement upward by flange 151 is released, movable contactor 13 is pushed up by a spring force of contact pressure spring 14, and movable contacts 21*a* and 21*b* move to the closed position in which movable contacts 21*a* and 21*b* are brought into contact with fixed contacts 22*a* and 22*b*.

At this time, an appropriate over-travel is set to shaft 15 so that shaft 15 can be further pushed up after movable contacts 21*a* and 21*b* are brought into contact with fixed contacts 22*a* and 22*b*. Since movable contactor 13 is urged upward by contact pressure spring 14, contact pressure between movable contacts 21*a* and 21*b* and fixed contacts 22*a* and 22*b* is secured. In a state shown in FIG. 2, contact device 2 is in a closed state. Consequently, contact bases 11 and 12 conduct with each other, and thus first output terminal 51 and second output terminal 52 conduct with each other.

Next, contact device 2 is described in detail. As shown in FIG. 1, contact device 2 includes fixed contacts 22*a* and 22*b* and movable contacts 21*a* and 21*b*. Furthermore, contact device 2 includes contact bases 11 and 12 supporting fixed contacts 22*a* and 22*b*, movable contactor 13 supporting movable contacts 21*a* and 21*b*, and contact pressure spring 14 for adjusting the contact pressure. Contact device 2 includes a pair of fixed contacts 22*a* and 22*b* and a pair of movable contacts 21*a* and 21*b*, so that a pair of contact base 11 and 12 is short-circuited via movable contactor 13 in a state in which contact device 2 is closed. Therefore, contact device 2 is inserted between battery 101 and load 102 so that direct-current power from travelling battery 101 (see FIG. 4)

is supplied to load 102 (see FIG. 4) through the pair of contact bases 11 and 12 and movable contactor 13. Note here that contact device 2 only need to be connected to load 102 in series between the output terminals of battery 101, and may be inserted between negative electrode (negative pole) of battery 101 and load 102.

When movable contacts 21*a* and 21*b* move in response to the movement of movable element 32 and movable element 32 is in the second position, contact device 2 is in a closed state in which movable contacts 21*a* and 21*b* are brought into contact with fixed contacts 22*a* and 22*b*. When movable element 32 is in the first position and the third position, contact device 2 is in an open state in which movable contacts 21*a* and 21*b* are away from fixed contacts 22*a* and 22*b*.

A pair of contact bases 11 and 12 of contact device 2 are arranged in one direction in a plane perpendicular to the vertical direction above electromagnet device 3. Contact bases 11 and 12 are formed in a columnar shape having a circular horizontal sectional. The pair of contact bases 11 and 12 are fixed at a predetermined distance from first yoke 34 and first stator 33 of electromagnet device 3.

Specifically, the pair of contact bases 11 and 12 are fixed to case 16 which is joined to first yoke 34. Case 16 is formed in a box shape whose bottom surface is opened. Fixed contacts 22*a* and 22*b* and movable contacts 21*a* and 21*b* are disposed between case 16 and yoke upper plate 341. Case 16 is formed of, for example, heat-resistant material such as ceramic. The peripheral edge of the bottom portion of case 16 is joined to the peripheral edge of the upper surface of yoke upper plate 341 via connector 17. Contact bases 11 and 12 are joined to case 16 in a state in which contact bases 11 and 12 are respectively inserted through round holes 19*a* and 19*b* formed in base plate 161 (upper wall) of case 16.

Note here that it is desirable that case 16, connector 17, yoke upper plate 341, and cylindrical body 36 form a hermetic container having space inside. Furthermore, it is desirable that the inside of the hermetic container be filled with arc-extinguishing gas mainly containing hydrogen. Thus, even if an arc discharge occurs when fixed contacts 22*a* and 22*b* and movable contacts 21*a* and 21*b* housed in the hermetic container become an open state, the arc discharge is quickly cooled by the arc-extinguishing gas and can be arc-extinguished rapidly. However, fixed contacts 22*a* and 22*b* and movable contacts 21*a* and 21*b* are not necessarily housed in a hermetic container.

Fixed contacts 22*a* and 22*b* are provided on the lower end part of contact bases 11 and 12, respectively. Contact bases 11 and 12 are formed of conductive material. The upper end parts of contact bases 11 and 12 are formed larger as compared with parts other than the upper end parts. First output terminal 51 is coupled to the upper end part of first contact base 11 via second exciting coil 41. Second output terminal 52 is coupled to the upper end part of second contact base 12. That is to say, second exciting coil 41 is inserted between first contact base 11 and first output terminal 51. As shown in FIG. 4, second exciting coil 41 is connected in series to contact device 2 between first output terminal 51 and second output terminal 52.

Movable contactor 13 is formed in a rectangular plate shape, and is disposed below contact bases 11 and 12 so that both end parts of movable contactor 13 in the longitudinal direction thereof face the lower end parts of contact bases 11 and 12. Movable contactor 13 is formed of conductive material. Movable contacts 21*a* and 21*b* are provided to movable contactor 13 in the portions confronting fixed contacts 22*a* and 22*b* of contact bases 11 and 12.

Movable contactor 13 is driven in the vertical direction by electromagnet device 3. Thus, movable contacts 21*a* and 21*b* provided to movable contactor 13 move between a closed position in which movable contacts 21*a* and 21*b* are brought into contact with the corresponding fixed contacts 22*a* and 22*b* and an open position in which movable contacts 21*a* and 21*b* are away from fixed contacts 22*a* and 22*b*. When movable contacts 21*a* and 21*b* are in the closed position, that is, contact device 2 is in a closed state, first contact base 11 and second contact base 12 are short-circuited to each other via movable contactor 13. Consequently, in a state in which contact device 2 is closed, first output terminal 51 and second output terminal 52 conduct with each other via second exciting coil 41, so that direct-current power is supplied from travelling battery 101 to load 102 via second exciting coil 41.

Contact pressure spring 14 is disposed between first stator 33 and movable contactor 13, and is a coil spring urging movable contactor 13 upward. A spring force of contact pressure spring 14 is set smaller than that of return spring 35.

Shaft 15 is formed of non-magnetic material having a round-bar shape extending in the vertical direction. Shaft 15 transmits a driving force generated in electromagnet device 3 to contact device 2 provided above electromagnet device 3. Shaft 15 has flange 151 at the upper end part thereof. The outer diameter of flange 151 is larger than that of the upper end part of shaft 15. Movable contactor 13 has hole 25 at the center portion thereof. The outer diameter of hole 25 is smaller than that of flange 151 of shaft 15. Shaft 15 is inserted through hole 25 of movable contactor 13 so that the upper surface of shaft 15 is brought into contact with flange 151 on the upper surface of movable contactor 13. Furthermore, shaft 15 passes through the inside of contact pressure spring 14, first stator 33, and return spring 35. The lower end part of shaft 15 is fixed to movable element 32.

From the above-mentioned configuration, the driving force generated in electromagnet device 3 is transmitted to movable contactor 13 by shaft 15. In response to the movement of movable element 32 in the vertical direction, movable contactor 13 moves in the vertical direction.

Next, trip device 4 is described. Trip device 4 has second exciting coil 41 connected in series to contact device 2. Trip device 4 moves movable element 32 to the third position with magnetic flux generated by second exciting coil 41 by not less than a prescribed value of abnormal current flowing through contact device 2 in a state in which movable element 32 is in the second position. Contact device 2, electromagnet device 3, and trip device 4 are arranged in one direction, and trip device 4 is disposed on the opposite side to contact device 2 with respect to electromagnet device 3.

Trip device 4 may include second stator 43 disposed on the opposite side to (i.e., below) first stator 33 with respect to movable element 32. In addition, trip device 4 may include second yoke 44.

When not less than a prescribed value of abnormal current flows through contact device 2 in a state in which movable element 32 is in the second position, magnetic flux is generated by second exciting coil 41. Then, with the magnetic flux, an attractive force in a reverse direction to first stator 33 acts on movable element 32. As s a result, movable element 32 is attracted to second stator 43, and movable element 32 moves to the third position.

That is to say, trip device 4 moves movable element 32 to the third position by the magnetic flux generated by second exciting coil 41 when second exciting coil 41 is energized. Thus, contact device 2 is forced to be an open state. Hereinafter, an operation in which trip device 4 makes contact device 2 to be in an open state is referred to as "trip." In other words, the "trip" denotes that movable element 32 moves (trips) from the second position to the first position or the third position.

Herein, the third position is on an extension of a moving axis of movement element 32 linking between the second position and the first position, and on the opposite side to (i.e., below) the second position with respect to the first position. In other words, the first position is a position (middle position) between the second position and the third position. In a state in which trip device 4 is not operated, movable element 32 is in the first position at the time of non-energization of first exciting coil 31, and in the second position at the time of energization of first exciting coil 31. When trip device 4 is operated, movable element 32 is in the third position as shown in FIG. 3. That is to say, when trip device 4 is operated in a state in which movable element 32 is in the second position, movable element 32 moves from the second position to the third position by way of the first position.

Second yoke 44 of trip device 4 includes lower plate 442 and lateral plate 443. Lower plate 442 and lateral plate 443 are formed of magnetic material. That is to say, second yoke 44 is formed of magnetic material. Second stator 43 is also formed of magnetic material. Consequently, second yoke 44, together with second stator 43 and movable element 32, forms a magnetic path (second magnetic path) through which magnetic flux generated at the time of energization of second exciting coil 41 passes (see FIGS. 7A and 7B).

Yoke lower plate 342 and bush 344 of first yoke 34 are used also as the upper plate of second yoke 44. Second yoke 44 has lower plate 442 below second exciting coil 41. Lower plate 442 faces yoke lower plate 342 of first yoke 34. Hereinafter, yoke lower plate 342 used also as the upper plate of second yoke 44, and bush 344 are described not only as a part of first yoke 34, but also as a member composing a part of second yoke 44.

Lateral plate 443 links the peripheral edge of yoke lower plate 342 and the peripheral edge of lower plate 442 to each other. Since yoke lower plate 342 and lower plate 442 are formed in a rectangular plate shape, respectively, a pair of lateral plates 443 are provided so that a pair of sides facing each other in the bottom surface of yoke lower plate 342 and a pair of sides facing each other in the top surface of lower plate 442 are linked to each other. Lateral plate 443 and lower plate 442 are formed unitarily by one plate.

Second exciting coil 41 is disposed in space surrounded by second yoke 44, and second stator 43 is disposed in the inner side of second exciting coil 41. Furthermore, in the inner side of second exciting coil 41, the lower end part of cylindrical body 36 is disposed. That is to say, cylindrical body 36 penetrates through yoke lower plate 342 of first yoke 34, and the lower end part of cylindrical body 36 extends to the inner side of second exciting coil 41.

Second stator 43 is a columnar fixed iron core protruding upward from the center portion of the upper surface of lower plate 442. The lower end part of second stator 43 is fitted into holding hole 28 formed in the center portion of lower plate 442, and thereby second stator 43 is fixed to second yoke 44. The outer diameter of second stator 43 is the same as that of movable element 32. That is to say, the outer diameter of second stator 43 is the same as that of first stator 33. Note here that the outer diameter of second stator 43 is not necessarily the same as the outer diameters of movable element 32 and first stator 33, it may be larger or smaller than the outer diameter of movable element 32. The effect when the outer diameter of first stator 33 is smaller than the outer diameter of second stator 43 is described later.

Herein, second stator 43 is disposed so that the upper end surface of second stator 43 is brought into contact with the lower surface of cylindrical body 36. Thus, in a state in which movable element 32 is in the second position (the state shown in FIG. 2), there is a gap between the upper end surface of second stator 43 and the lower end surface of movable element 32. The gap has a size corresponding to gap G1 plus a thickness of the base plate of cylindrical body 36. Furthermore, in a state in which movable element 32 is in the third position (the state shown in FIG. 3), the upper end surface of second stator 43 and the lower end surface of movable element 32 are brought into contact with each other via the base plate of cylindrical body 36. Note here that it is not essential that the upper end surface of second stator 43 be brought into contact with the bottom surface of cylindrical body 36, and there may be a clearance between the upper end surface of second stator 43 and the bottom surface of cylindrical body 36.

Herein, trip device 4 is configured such that all of movable element 32, second exciting coil 41, and second stator 43 have a central axis on the same line along the vertical direction.

Trip device 4, contact device 2, and electromagnet device 3 are arranged in one direction (vertical direction). Trip device 4 is disposed on the opposite side to contact device 2 with respect to electromagnet device 3. That is to say, trip device 4 is disposed below electromagnet device 3.

Herein, second exciting coil 41 is connected in series to contact device 2 between first output terminal 51 and second output terminal 52 as described above. In this exemplary embodiment, second exciting coil 41 is connected between first contact base 11 and first output terminal 51. Thus, second exciting coil 41 forms a part of a path of a load current supplied from travelling battery 101 to load 102 in a state in which contact device 2 is closed, and second exciting coil 41 is excited by the load current.

Note here that bypass path 6 may be electrically connected in parallel to second exciting coil 41 so that a load current can be allowed to flow in a path other than second exciting coil 41 (see FIG. 4). When bypass path 6 is provided, since a part of the load current supplied from travelling battery 101 to load 102 flows in bypass path 6, loss in second exciting coil 41 can be reduced.

At this time, due to magnetic flux generated by second exciting coil 41, a magnetic attractive force is generated between movable element 32 and second stator 43. That is to say, a force to attract movable element 32 downward is generated. In other words, second exciting coil 41 generates magnetic flux to a magnetic path formed by second yoke 44, second stator 43, and movable element 32. Consequently, an attractive force, in a direction in which movable element 32 is moved such that the magnetic resistance of the magnetic path is reduced, acts on movable element 32. In other words, trip device 4 allows an attractive force to act on movable element 32 in a direction in which movable element 32 is moved from the second position to the third position such that a gap in the magnetic path between the upper end surface of second stator 43 and the lower end surface of bush 344 is filled with movable element 32.

Figure 5:
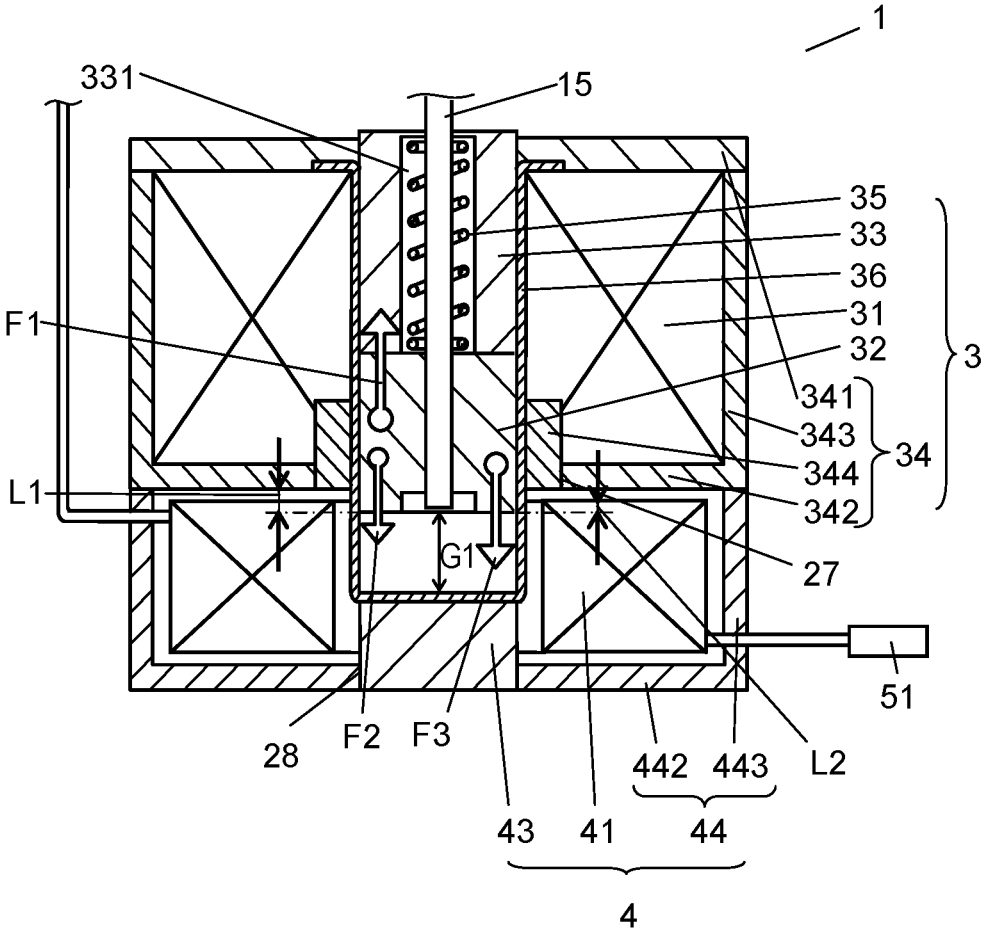
FIG. 5 is a sectional schematic view showing a principal part of the electromagnetic relay in accordance with the first exemplary embodiment.

As a result, in electromagnetic relay 1 having the above-mentioned configuration, in a state in which first exciting coil 31 is energized and contact device 2 is closed, that is, in a state in which movable element 32 is in the second position (see FIG. 2), forces shown in FIG. 5 act on movable element 32. FIG. 5 is a sectional schematic view showing a principal part of electromagnetic relay 1 in accordance with this exemplary embodiment. A first force F1 as a magnetic attractive force between movable element 32 and first stator 33 acts upward on movable element 32. A second force F2 as a spring force and a third force F3 as a magnetic attractive force between movable element 32 and second stator 43 act downward on movable element 32.

The first force F1 is an attractive force acting on movable element 32 from first stator 33 by magnetic flux generated by first exciting coil 31 when first exciting coil 31 is energized in electromagnet device 3. The second force F2 is a force synthesizing a spring force acting on movable element 32 from return spring 35 and a spring force acting on movable element 32 from contact pressure spring 14 via movable contactor 13 and shaft 15. That is to say, the second force F2 is a force obtained by subtracting a force acting upward from contact pressure spring 14 to movable element 32 from a force acting downward on movable element 32 from return spring 35. The third force F3 is an attractive force acting on movable element 32 from second stator 43 by magnetic flux generated by second exciting coil 41 when second exciting coil 41 is energized, in trip device 4.

The third force F3 as an attractive force acting on movable element 32 from second stator 43 is represented by the following mathematical formula (Math. 1).

$$F3 = \frac{N^2 \times I^2 \times S \times \mu_0}{2g^2} \quad \text{[Math. 1]}$$

In the formula discussed above, "N" represents the number of windings of second exciting coil 41, "I" represents an amount of electric current flowing in second exciting coil 41, "S" represents an area of movable element 32 facing second stator 43, "$\mu_0$ to" represents magnetic permeability in vacuum, "g" is a clearance (gap) between movable element 32 and second stator 43.

In electromagnetic relay 1, in a state in which movable element 32 is in the second position, when the first force F1 is smaller than a sum of the second force F2 and the third force F3 (F1<F2+F3), movable element 32 is moved to the third position by trip device 4, and contact device 2 is forced to be in an open state. In short, movable element 32 is in the second position when the first force F1 acting upward is larger than the sum of the second force F2 and the third force F3 acting downward, and movable element 32 moves to the third position when the first force F1 is smaller than the sum of the second force F2 and the third force F3.

Herein, trip device 4 trips not when a load current simply flows in second exciting coil 41, but trips for the first time when the third force F3 as an attractive force acting on movable element 32 from second stator 43 satisfies the above-mentioned condition (F1<F2+F3). The attractive force acting on movable element 32 from second stator 43 varies depending upon the amount of electric current (load current) flowing in second exciting coil 41. Thus, trip device 4 is configured such that the third force F3 as an attractive force acting on movable element 32 from second stator 43 satisfies the above-mentioned condition (F1<F2+F3) when the electric current flowing in second exciting coil 41 becomes an abnormal current that is not less than the prescribed value of electric current.

That is to say, when not less than a prescribed value of abnormal current such as an overcurrent and a short-circuit current flows in contact device 2, trip device 4 moves movable element 32 to the third position. Specifically, in trip device 4, the number of windings of second exciting coil 41 and gaps G1 (see FIG. 5) are set so that movement element 32 is attracted to second stator 43 by the third force F3 satisfying the above-mentioned condition when not less than the prescribed value of electric current flows in second exciting coil 41. Herein, a prescribed value at which trip device 4 starts to operate is set to, for example, a value that is sufficiently large overcurrent with respect to the rated current of electromagnetic relay 1, or that becomes a short-circuit current. Herein, the overcurrent is, for example, an electric current that is about 5 to 10 times larger than the rated current. Furthermore, the short-circuit current is, for example, about several tens of times larger than the rated current.

Thus, when an abnormal current such as an overcurrent and a short-circuit current flows through contact device 2, trip device 4 moves movable element 32 to the third position, and thus contact device 2 is forced to be in an open state. When contact device 2 is in a closed state, movable element 32 is attracted to first stator 33 by the magnetic flux generated by first exciting coil 31. Then, when the sum of the second force F2 and the third force F3 is larger than the attractive force, movable element 32 is attracted to second stator 43. Furthermore, in tripping, the nearer to second stator 43 movable element 32 is, the larger the attractive force between second stator 43 and movable element 32 becomes. Consequently, a speed at which contact device 2 is opened is gradually increased.

As mentioned above, electromagnetic relay 1 forcibly restores movable element 32 by using the magnetic flux generated when an abnormal current flows. As a result, generation of the abnormal current is promptly detected, and an electric circuit (contact device 2) is disconnected rapidly.

Herein, a member for forming a magnetic path through which magnetic flux generated by second exciting coil 41 is allowed to pass is referred to as a second magnetic path member. The second magnetic path member includes movable element 32, second stator 43, and second yoke 44. Furthermore, second yoke 44 includes yoke lower plate 342, bush 344, lower plate 442, and lateral plate 443. It is desirable that the second magnetic path member be configured such that the minimum value of a cross-sectional area of the magnetic path becomes a predetermined lower limit value or more. That is to say, in trip device 4, when the cross-sectional area of the above-mentioned magnetic path is made to be larger, even when excessive electric current such as a short-circuit current flows into second exciting coil 41, magnetic saturation does not easily occur.

Furthermore, a member for forming a magnetic path through which the magnetic flux generated by first exciting coil 31 is allowed to pass is referred to as a first magnetic path member. The first magnetic path member includes movable element 32, first stator 33, and first yoke 34. Furthermore, first yoke 34 includes yoke upper plate 341, yoke lower plate 342, yoke lateral plate 343, and bush 344. It is desirable that the first magnetic path member be configured such that the minimum value of a cross-sectional area of the magnetic path is smaller as compared with the second magnetic path member. That is to say, it is desirable that the minimum value of the cross-sectional area of the first magnetic path be smaller than the minimum value of the cross-sectional area of the second magnetic path. For example, it is preferable that the diameter of at least a part of the first magnetic path member (for example, first stator 33) is formed to be smaller than the diameter of a part of the second magnetic path member (for example, second stator 43). That is to say, when first stator 33 is a cylindrical fixed iron core, and second stator 43 is a columnar fixed iron core, it is preferable that the outer diameter of first stator 33 is smaller than the outer diameter of second stator 43.

Thus, magnetic resistance of the magnetic path through which the magnetic flux generated by first exciting coil 31 passes is relatively higher than the magnetic resistance of the magnetic path through which the magnetic flux generated by second exciting coil 41 passes. Therefore, an attractive force generated between movable element 32 and second stator 43 becomes larger. Consequently, the speed at which contact device 2 is opened is increased, and electromagnetic relay 1 can rapidly disconnect the electric circuit (contact device 2) by using the magnetic flux generated when an abnormal current flows.

Furthermore, it is desirable that the first magnetic path member be configured such that the minimum value of a cross-sectional area of the magnetic path is a predetermined upper limit value or less. For example, it is preferable that the diameter of at least a part of the first magnetic path member (for example, first stator 33) is formed to be smaller than the diameter of a part of the second magnetic path member (for example, second stator 43).

Thus, the magnetic path through which the magnetic flux generated by first exciting coil 31 passes is easily magnetically saturated, and an attractive force generated between movable element 32 and first stator 33 becomes smaller. Therefore, an attractive force of movable element 32 necessary for tripping becomes smaller, trip device 4 can trip by a relatively small force. As a result, the speed at which contact device 2 is opened is increased, electromagnetic relay 1 can rapidly disconnect the electric circuit (contact device 2) by using the magnetic flux generated when an abnormal current flows.

Figure 6:
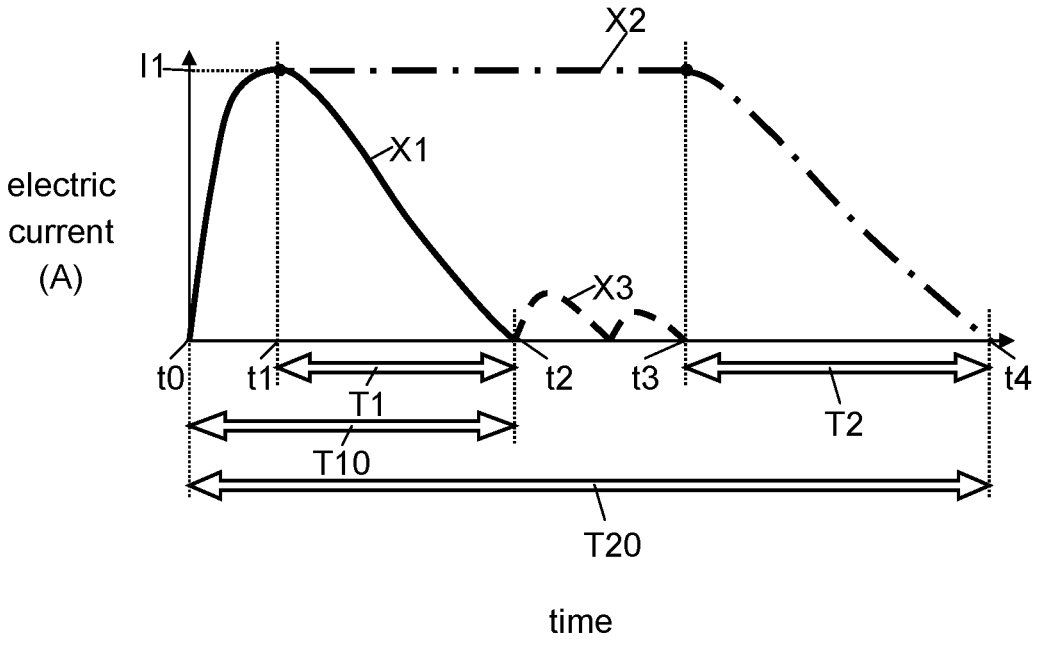
FIG. 6 is a graph showing load currents of the electromagnetic relay in accordance with the first exemplary embodiment.

Next, a configuration in which electromagnetic relay 1 is provided with trip device 4 mentioned above, an electric circuit can be promptly disconnected in response to an abnormal current from the closed state of contact device 2 is briefly described with reference to FIG. 6. FIG. 6 is a graph showing load currents of electromagnetic relay 1 in accordance with this exemplary embodiment. The graph shows load currents flowing in the electric circuit (contact device 2) between battery 101 (see FIG. 4) and load 102, where the abscissa represents time, and the ordinate represents an electric current. Herein, it is assumed that load 102 is short-circuited at time t0. Load current X1 represents a load current when electromagnetic relay 1 having trip device 4 in accordance with this exemplary embodiment is used. Load current X2 represents a load current when an electromagnetic relay without having trip device 4 is used.

In the case of load current X2 when trip device 4 is not provided, the electromagnetic relay is short-circuited at time t0, and cannot immediately make contact device 2 open even when load current X2 increases and reaches prescribed value I1 at time t1. In this case, load current X2 starts to decrease from time t3 at which electronic control unit 103 senses occurrence of an abnormal current by a protection function, and turns off switching element 104 by a control signal, so that energization of first exciting coil 31 is stopped. Further interrupting time period T2 is required by the time when the arc discharge between fixed contacts 22*a* and 22*b* and movable contacts 21*a* and 21*b* is arc-extinguished, and load current X2 is interrupted. Therefore, load current X2 is interrupted at time t4 when time period T20 has passed from time t0.

On the other hand, when trip device 4 is provided, electromagnetic relay 1 is short-circuited at time t0, and then, a load current X1 increases and reaches prescribed value I1 at time t1, trip device 4 makes contact device 2 open. Therefore, in this case, the load current X1 starts to decrease from time t1 at which the load current X1 reaches the prescribed value. Further interrupting time period T1 is required by the time when the arc discharge between fixed contacts 22*a* and 22*b* and movable contacts 21*a* and 21*b* is arc-extinguished, and a load current X1 is interrupted. The load current X1 is interrupted at time t2 when time period T10 has passed from time t0. Herein, time period T10 is much shorter than time period T20.

Note here that, in electromagnetic relay 1 having trip device 4, trip device 4 trips using a load current. Therefore, by time t3 at which the energization of first exciting coil 31 is stopped, after the load current is interrupted, contact device 2 becomes a closed state again and chattering may occur. In FIG. 6, a load current X3 shows a load current due to chattering. However, a load current X1 shown in FIG. 6 is a conceptual waveform. Therefore, actually, before a predetermined attractive force is generated in trip device 4, overshooting may occur in the load current X1. Therefore, a waveform obtained by electromagnetic relay 1 of this exemplary embodiment is not limited to the waveform shown in FIG. 6.

Furthermore, it is also advantageous that when electromagnetic relay 1 has trip device 4, an increase of the load current can be reduced. That is to say, if trip device 4 is not provided, even when load current X2 reaches a predetermined electric current (overcurrent), contact device 2 is not immediately opened. Therefore, load current X2 may continue to increase and reach a short-circuit current larger than the overcurrent. On the contrary, when trip device 4 is provided, when the load current X1 reaches an overcurrent, contact device 2 is immediately opened. Therefore, the electric circuit is disconnected before load current X1 reaches a short-circuit current. Herein, the overcurrent is, for example, an electric current that is about 5 to 10 times larger than the rated current; the short-circuit current is, for example, about several tens of times larger than the rated current.

As mentioned above, electromagnetic relay 1 of this exemplary embodiment has trip device 4. Consequently, when not less than a prescribed value of abnormal current flows through contact device 2, movable element 32 is attracted due to magnetic flux generated by second exciting coil 41, and movable element 32 moves to the third position. Therefore, electromagnetic relay 1 can promptly turn off contact device 2 when an abnormal current such as an overcurrent and a short-circuit current flows in contact device 2.

Furthermore, contact device 2, electromagnet device 3, and trip device 4 are disposed in one direction; trip device 4 is disposed on the opposite side to contact device 2 with respect to electromagnet device 3. Since trip device 4 is added to the outer side of electromagnet device 3 and contact device 2, it is possible to share components such as movable element 32 with the components of an electromagnetic relay without having trip device 4. As a result, in electromagnetic relay 1, components such as movable element 32 may not be particularly designed.

In addition, it is preferable that trip device 4 has second stator 43 disposed on the opposite side to first stator 33 with respect to movable element 32. When second stator 43 attracts movable element 32, movable element 32 moves to the third position. When second stator 43 is disposed, an attractive force acting on movable element 32 becomes larger as compared with the case where second stator 43 is not provided, movable element 32 moves to the third position promptly. As a result, when an abnormal current such as an overcurrent and a short-circuit current flows in contact device 2, contact device 2 is turned off promptly. Note here that second stator 43 is not essential configuration, it may be omitted appropriately.

Figure 7A:
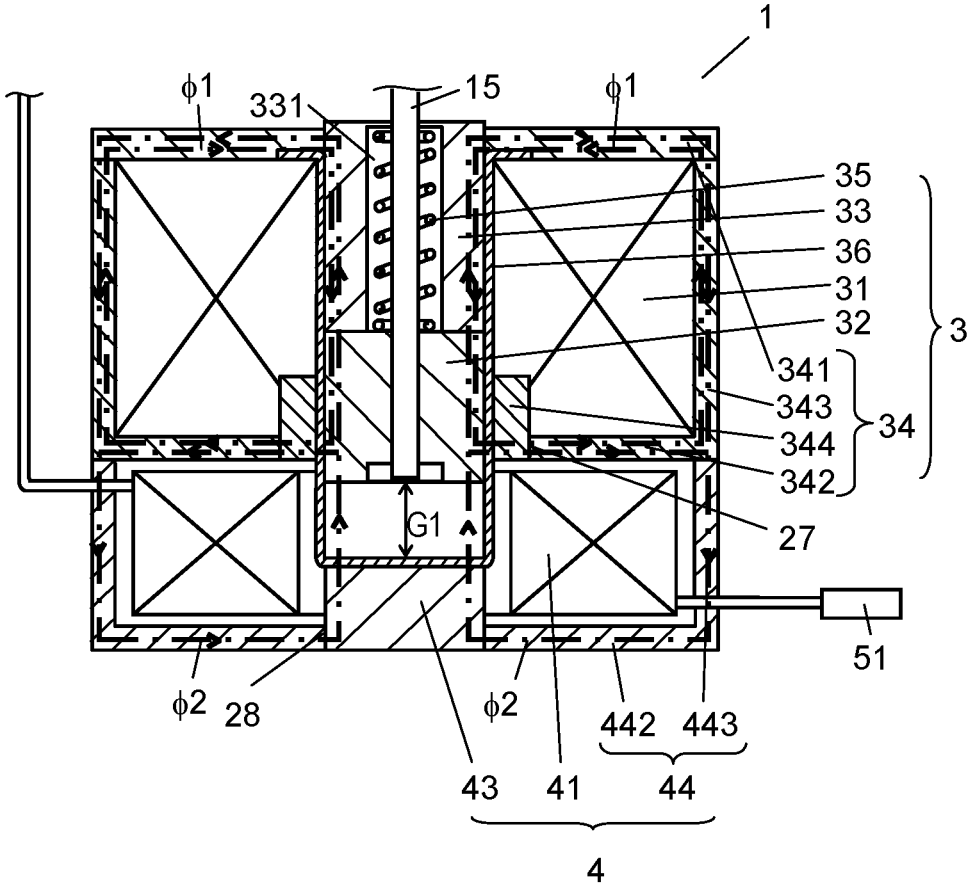
FIG. 7A is a sectional schematic view showing a principal part of the electromagnetic relay in accordance with the first exemplary embodiment.
Figure 7B:
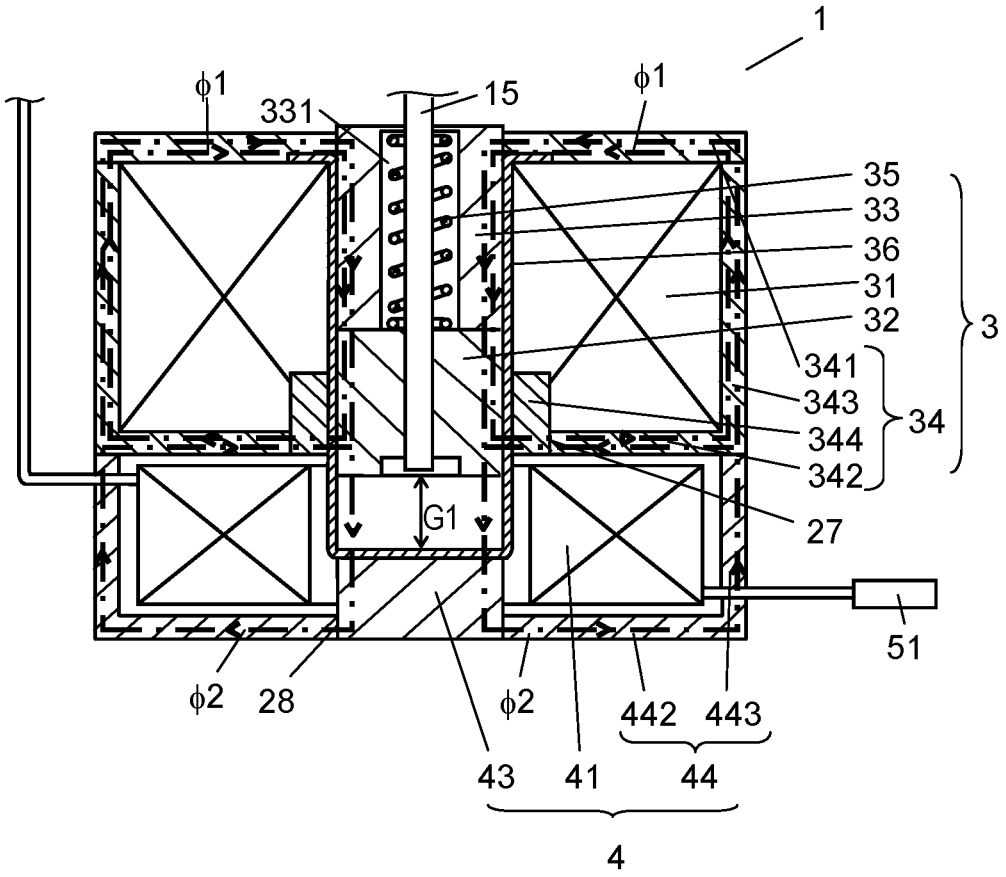
FIG. 7B is a sectional schematic view showing the principal part of the electromagnetic relay in accordance with the first exemplary embodiment.

FIGS. 7A and 7B are sectional schematic views each showing a principal part of electromagnetic relay 1 in accordance with the first exemplary embodiment. In electromagnetic relay 1 of this exemplary embodiment, a magnetic path through which magnetic flux generated by second exciting coil 41 is allowed to pass is formed so that a part of the magnetic flux generated by second exciting coil 41 passes through first stator 33 and movable element 32 in a state in which movable element 32 is in the second position. That is to say, as shown in FIGS. 7A and 7B, a part of magnetic flux $\phi 2$ generated by second exciting coil 41 in a state in which movable element 32 is in the second position passes through first stator 33 and movable element 32.

In this exemplary embodiment, as shown in FIG. 7A, for example, second exciting coil 41 is configured such that magnetic flux (third magnetic flux) is generated in a reverse direction to first exciting coil 31 in first stator 33 and movable element 32. That is to say, in a state in which movable element 32 is in the second position, first exciting coil 31 generates first magnetic flux which passes through first stator 33 and movable element 32, and second exciting coil 41 generates third magnetic flux in a reverse direction to first magnetic flux, between first stator 33 and movable element 32. That is to say, the winding direction of second exciting coil 41 is set so that magnetic flux $\phi 2$ in the direction shown in FIG. 7A is generated at the time of energization. With this configuration, in first stator 33 and movable element 32, magnetic flux $\phi 2$ generated by second exciting coil 41 acts so as to cancel magnetic flux $\phi 1$ generated by first exciting coil 31.

Therefore, an attractive force (first force F1 in FIG. 5) between first stator 33 and movable element 32, generated by first exciting coil 31, is weekend by magnetic flux $\phi 2$ generated by second exciting coil 41, and trip device 4 can attract movable element 32 to second stator 43 with a relatively small force. Consequently, the number of windings of second exciting coil 41 can be reduced.

However, as another configuration example of this exemplary embodiment, as shown in FIG. 7B, magnetic flux $\phi 2$ generated by second exciting coil 41 in first stator 33 and movable element 32 may be in the same direction as magnetic flux $\phi 1$ generated by first exciting coil 31. That is to say, in a state in which movable element 32 is in the second position, first exciting coil 31 may generate first magnetic flux passing through first stator 33 and movable element 32, and second exciting coil 41 may generate fourth magnetic flux that is in the same direction as first magnetic flux between first stator 33 and movable element 32. That is to say, the winding direction of second exciting coil 41 is set so that magnetic flux $\phi 2$ in the direction shown in FIG. 7B is generated at the time of energization. With this configuration, magnetic flux $\phi 2$ generated by second exciting coil 41 between first stator 33 and movable element 32 acts so as to strengthen an attractive force between first stator 33 and movable element 32 by first exciting coil 31 (first force F1 in FIG. 5).

In trip device 4 shown in FIG. 7B, when the number of windings of second exciting coil 41 is the same, an electric current value (prescribed value) at the time of tripping becomes larger as compared with the configuration shown in FIG. 7A, but an attractive force acting between second stator 43 and movable element 32 is increased in tripping. Therefore, when an electric current value (prescribed value) at the time of tripping is set larger, electromagnetic relay 1 has an advantage that an opening speed of contact device 2 in tripping becomes higher in a configuration shown in FIG. 7B.

Furthermore, in this exemplary embodiment, electromagnet device 3 is a so-called plunger type electromagnet device configured so as to allow movable element 32 to travel in a straight line in the vertical direction between the first position and the second position as mentioned above. Therefore, electromagnet device 3 and trip device 4 may allow attractive forces to act in the opposite direction to each other on movable element 32, thus enabling an attractive force to act efficiently. Herein, second yoke 44, together with movable element 32 and second stator 43, forms a magnetic path through which magnetic flux generated by second exciting coil 41 is allowed to pass.

Furthermore, yoke lower plate 342 and bush 344 are magnetically connected to second yoke 44 and movable element 32, respectively. It is preferable that the shortest distance from yoke lower plate 342 and bush 344 to second stator 43 is longer than the shortest distance from movable element 32 to second stator 43. In other words, as shown in FIG. 5, it is preferable that in a state in which movable element 32 is in the second position, the lower end surface of movable element 32 protrudes to a second stator 43 side (downward) by a predetermined amount L1 from the lower end surfaces of yoke lower plate 342 and bush 344.

With this configuration, in magnetic flux generated by second exciting coil 41, leakage of magnetic flux passing between second stator 43 and yoke lower plate 342 or bush 344 without passing through movable element 32 is reduced. Consequently, the magnetic flux generated by the second exciting coil 41 is concentrated on between movable element 32 and second stator 43, thus increasing an attractive force acting between movable element 32 and second stator 43. Therefore, when an electric current value (prescribed value) at which tripping is carried out is the same, the number of windings of second exciting coil 41 can be reduced. When the number of windings of second exciting coil 41 is the same, an electric current value at which tripping is carried out can be made small.

Furthermore, it is desirable that second exciting coil 41 be wound around a moving axis of movable element 32, and disposed such that at least a part of second exciting coil 41 overlaps with movable element 32 in the second position in the direction perpendicular to the direction in which movable element 32 moves. That is, it is preferable that at least a part of the second exciting coil is disposed in the periphery of at least a part of the movable element located in the second position. That is to say, second exciting coil 41 is configured such that the lower end part of movable element 32 in the second position is inserted. In other words, in the second position as shown in FIG. 5, it is preferable that movable element 32 is configured such that the lower end surface of movable element 32 protrudes from the upper end surface of second exciting coil 41 toward a second stator 43 side (below) by a predetermined amount L2.

With this configuration, a part (lower end part) of movable element 32 is disposed in the inner side of second exciting coil 41 having magnetic flux density larger than in the outer side of second exciting coil 41, so that an attractive force acting between movable element 32 and second stator 43 is increased. Therefore, when the electric current value (prescribed value) at which tripping is carried out is the same, the number of windings of second exciting coil 41 can be reduced. When the number of windings of second exciting coil 41 is the same, an electric current value at which tripping is carried out can be reduced.

In addition, it is desirable that a distance between second stator 43 and movable element 32 located in the second position be shorter. When movable element 32 is located in the second position, that is, when contact device 2 is in the closed state, as a gap between second stator 43 and movable element 32 is smaller, an attractive force of movable element 32, which is required for tripping, is reduced. Therefore, trip device 4 can trip with a relatively small force.

Figure 8:
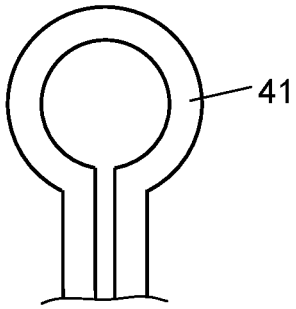
FIG. 8 is a schematic view of an example of a second exciting coil of the electromagnetic relay in accordance with the first exemplary embodiment.

Furthermore, as shown in FIG. 8, it is desirable that the number of windings of second exciting coil 41 be not more than one turn. The magnetomotive force of second exciting coil 41 is expressed by the product of the amount of electric current flowing in second exciting coil 41 and the number of windings of second exciting coil 41 (the number of turns). The magnetic flux generated by second exciting coil 41 is needed when excessive abnormal current such as an over-current and a short-circuit current flows in second exciting coil 41. For example, assuming several thousands A of short-circuit current, second exciting coil 41 generates sufficient magnetomotive force even if the number of windings is not more than one turn.

A load current supplied from travelling battery 101 to load 102 flows through second exciting coil 41. Therefore, in order to suppress loss (copper loss) in second exciting coil 41, it is desirable that the coil wire (copper wire) have a larger wire diameter and a shorter wire length. When the number of windings of second exciting coil 41 is suppressed to not more than one turn, in second exciting coil 41, the wire diameter can be made larger and the wire length can be made shorter in the coil wire. Furthermore, when the wire length of the coil wire of second exciting coil 41 is short, reduction in cost and size can be achieved.

In addition, it is desirable that second exciting coil 41 be formed of metal. By subjecting a metal plate to processing such as punching and bending, second exciting coil 41 can be formed. In this case, the number of windings of second exciting coil 41 may be one turn as shown in FIG. 8, or second exciting coil 41 may be formed in a spiral shape or a helical shape so that at least a part of the number of windings is more than two.

Figure 9:
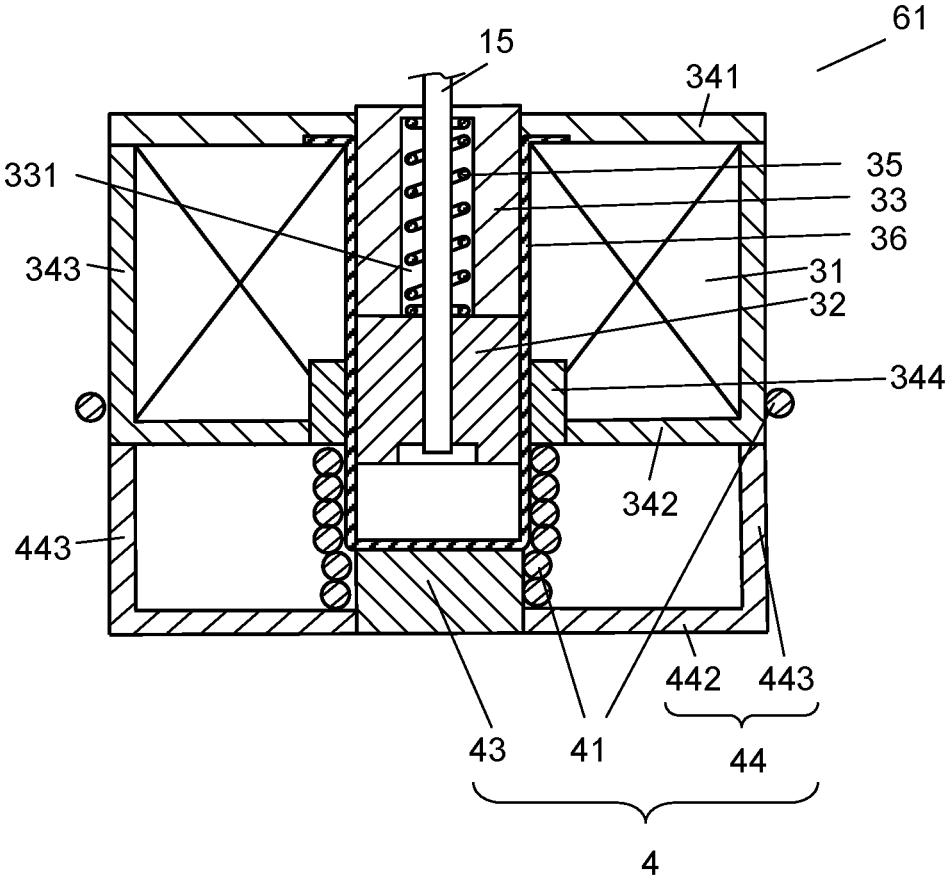
FIG. 9 is a sectional schematic view showing a principal part of another electromagnetic relay in accordance with the first exemplary embodiment.

Herein, when first exciting coil 31 and second exciting coil 41 are wound around the same axis (the moving axis of movable element 32) along the movement direction of movable element 32 (vertical direction), at least a part of second exciting coil 41 may be disposed to overlap with first exciting coil 31 as shown in FIG. 9. FIG. 9 is a sectional schematic view showing a principal part of another electromagnetic relay 61 in accordance with the first exemplary embodiment. As shown in FIG. 9, the axis around which first exciting coil 31 is wound and the axis around which second exciting coil 41 is wound are identical to each other. Second exciting coil 41 may be disposed such that the upper end part thereof is wound around the periphery of the lower end part of first exciting coil 31. In the example of FIG. 9, one turn in the upper side of second exciting coil 41 is wound around the outer periphery of first yoke 34, and the remaining turns are wound around the inner side of second yoke 44. Thus, the increase of the dimension by addition of trip device 4 in the vertical direction of electromagnetic relay 1 can be suppressed, and the dimension in the vertical direction can be re duce d.

Furthermore, in this exemplary embodiment, contact device 2 includes contact pressure spring 14 generating a force in the direction pressing movable contacts 21*a* and 21*b* against fixed contacts 22*a* and 22*b* when movable element 32 is in the second position. Therefore, contact device 2 can secure a sufficient contact pressure force between movable contacts 21*a* and 21*b* and fixed contacts 22*a* and 22*b* when movable element 32 is in the second position.

In a state in which movable element 32 is in the second position, an electromagnetic repulsive force is generated in the direction so as to separate movable contacts 21*a* and 21*b* from fixed contacts 22*a* and 22*b* by an electric current flowing in contact device 2. It is desirable that an electric current value (prescribed value) at which tripping is carried out be set smaller than a value of electric current flowing in contact device 2 when the above-mentioned electromagnetic repulsive force is balanced with a spring force of contact pressure spring 14. That is to say, in electromagnetic relay 1, it is desirable that the electric current value (prescribed value) at which tripping is carried out be set considering the electromagnetic repulsive force and the spring force of contact pressure spring 14.

In more detail, at the time of energization of first exciting coil 31, an electromagnetic repulsive force generated by an electric current flowing through movable contactor 13 from one of contact bases 11 and 12 to the other acts downward in movable contactor 13 (see FIGS. 1 to 3). That is to say, when an electric current flows from one of the contact bases 11 and 12 to the other through movable contactor 13, magnetic flux is generated by the electric current in the periphery of movable contactor 13. By this magnetic flux magnetic flux and the electric current flowing in movable contactor 13, Lorentz's force (electromagnetic repulsive force) in the direction in which movable contacts 21*a* and 21*b* are separated from fixed contacts 22*a* and 22*b* (downward) acts on movable contactor 13.

Since this electromagnetic repulsive force is smaller than a spring force of contact pressure spring 14 in normal time, movable contactor 13 receives an upward force from contact pressure spring 14 and maintains a state in which movable contacts 21*a* and 21*b* are brought into contact with fixed contacts 22*a* and 22*b*. However, when an electric current flowing in contact device 2 becomes a large electric current such as a short-circuit current, the electromagnetic repulsive force acting on movable contactor 13 exceeds the spring force of contact pressure spring 14. As a result, movable contacts 21*a* and 21*b* may be away from fixed contacts 22*a* and 22*b*. In this way, in a state in which the electromagnetic repulsive force exceeds the spring force of contact pressure spring 14, an arc discharge may occur between movable contacts 21*a* and 21*b* and fixed contacts 22*a* and 22*b* and contact welding may occur. Occurrence of the contact welding increases a force necessary to move movable contactor 13 so as to separate movable contacts 21*a* and 21*b* from fixed contacts 22*a* and 22*b*. As a result, electromagnetic relay 1 is required to have a larger force necessary for tripping.

It is therefore desirable that an electric current value (prescribed value) at which tripping is carried out be set smaller than a value of electric current in a balanced state with the spring force of contact pressure spring 14. Thus, even if an electric current flowing in contact device 2 is increased, tripping can be carried out before the electromagnetic repulsive force exceeds the spring force of contact pressure spring 14. Thus, contact welding caused by the electromagnetic repulsive force does not easily occur.

Figure 10:
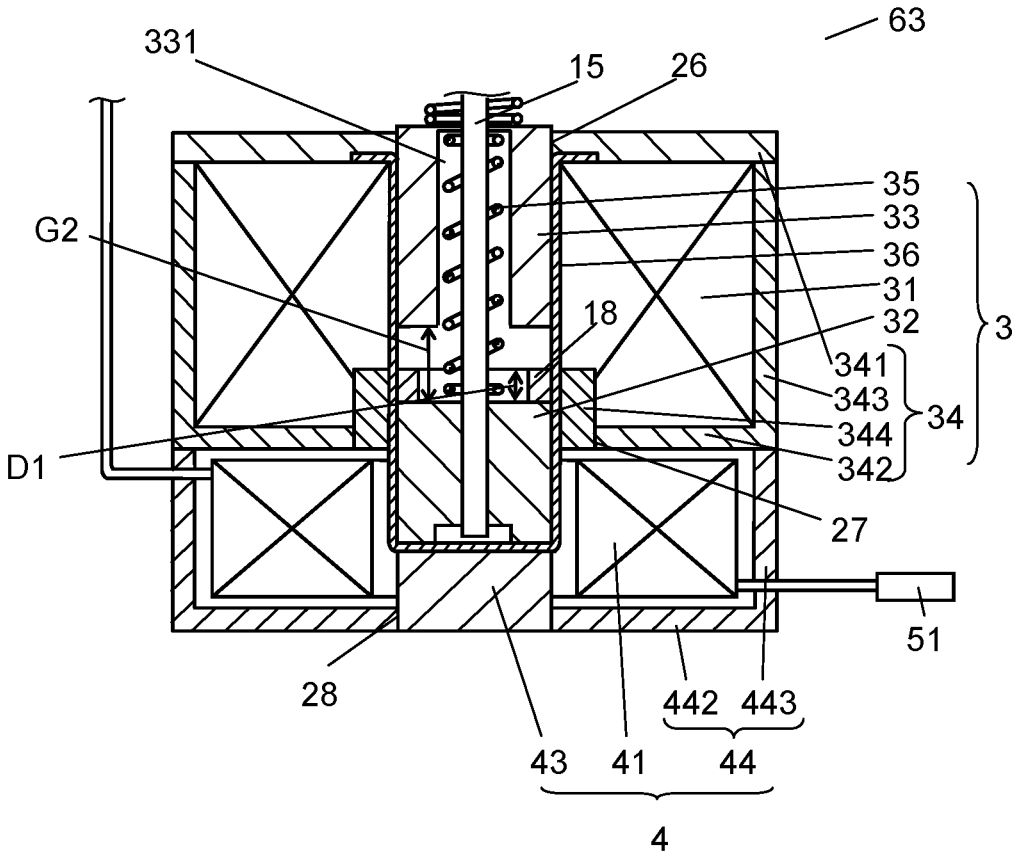
FIG. 10 is a sectional schematic view showing a principal part of still another electromagnetic relay in accordance with the first exemplary embodiment.

FIG. 10 is a sectional schematic view showing a principal part of another electromagnetic relay 63 in accordance with this exemplary embodiment. As shown in FIG. 10, electromagnet device 3 may include adjusting member 18 made of non-magnetic material between movable element 32 and first stator 33. In an example of FIG. 10, adjusting member 18 is a ring-shaped residual (spacer), which is disposed on the upper surface of movable element 32 and through which shaft 15 is inserted. Herein, adjusting member 18 is formed to have the same outer diameter as that of movable element 32, and is attached (adhesively bonded) to movable element 32 so that adjusting member 18 moves along with movable element 32. However, the outer diameter of adjusting member 18 may not be the same as that of movable element 32. Adjusting member 18 may have a shape other than a ring shape. Furthermore, adjusting member 18 may be attached to first stator 33 instead of movable element 32.

When adjusting member 18 is disposed between movable element 32 and first stator 33, even when movable element 32 is in the second position, movable element 32 is not brought into contact with first stator 33. That is to say, even when contact device 2 is in a closed state, movable element 32 is away from first stator 33, so that an attractive force acting between movable element 32 and first stator 33 is reduced.

Figure 11:
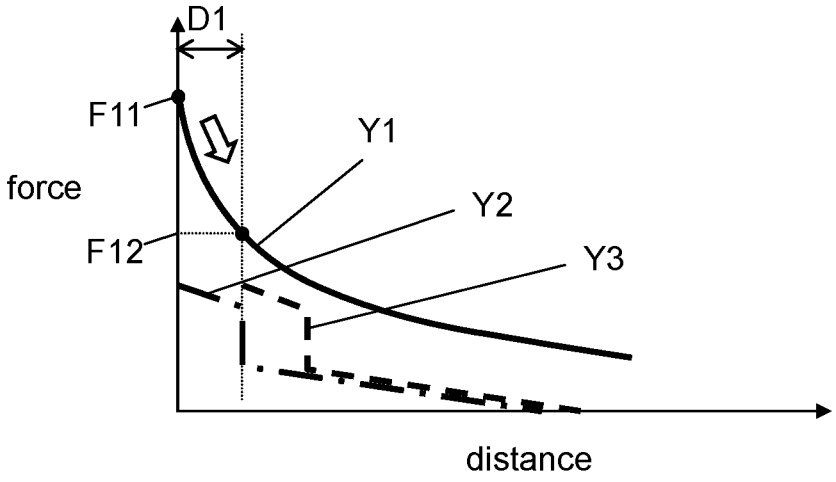
FIG. 11 is a graph showing forces acting on a movable element of the electromagnetic relay in accordance with the first exemplary embodiment.

FIG. 11 is a graph showing forces acting on movable element 32 of electromagnetic relay 63 in accordance with this exemplary embodiment. In FIG. 11, the abscissa represents a distance between movable element 32 and first stator 33; the ordinate represents forces. FIG. 11 shows an attractive force Y1 acting on movable element 32 from first stator 33, a spring force Y2 acting on movable element 32 when adjusting member 18 is not provided, and a spring force Y3 acting on movable element 32 when adjusting member 18 is provided. The attractive force Y1 acting on movable element 32 from first stator 33 corresponds to first force F1 shown in FIG. 5. The spring forces Y2 and Y3 acting on movable element 32 correspond to a second force F2 shown in FIG. 5. As shown in FIG. 11, the larger the distance between movable element 32 and first stator 33 is, the smaller the attractive force Y1 acting on movable element 32 from first stator 33 is.

With the configuration of electromagnetic relay 63 shown in FIG. 10, interval D1 corresponding to a thickness of adjusting member 18 is generated between movable element 32 in the second position and first stator 33. The attractive force Y1 acting on movable element 32 is reduced from F11 to F12. When adjusting member 18 is provided, an attractive force necessary for tripping, between movable element 32 and second stator 43, needs to be larger than a value obtained by subtracting a spring force $\alpha$ from F12. Furthermore, when adjusting member 18 is not provided, an attractive force necessary for tripping, between movable element 32 and second stator 43, needs to be larger than a value obtained by subtracting a spring force $\alpha$ from F11. Therefore, when adjusting member 18 is provided, as compared with the case where adjusting member 18 is not provided, the attractive force necessary for tripping can be reduced. Herein, the attractive force necessary for tripping, between movable element 32 and second stator 43, corresponds to a third force F3 shown in FIG. 5. Herein, the spring force $\alpha$ is a spring force when movable element 32 is in the second position, and its value is assumed to be the same regardless of the presence of adjusting member 18.

Figure 12:
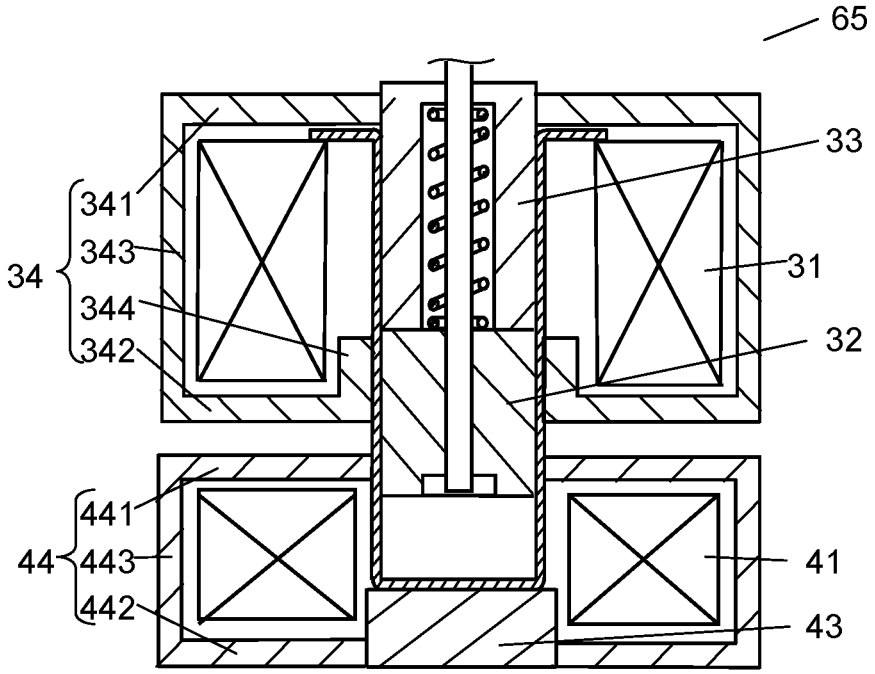
FIG. 12 is a sectional schematic view showing a principal part of yet another electromagnetic relay in accordance with the first exemplary embodiment.

FIG. 12 is a sectional schematic view showing a principal part of yet another electromagnetic relay 65 in accordance with the first exemplary embodiment. As shown in FIG. 12, first yoke 34 through which magnetic flux generated by first exciting coil 31 is allowed to pass may be a separate body from second yoke 44 through which magnetic flux generated by second exciting coil 41 is allowed to pass. A magnetic path through which magnetic flux generated by first exciting coil 31 is allowed to pass is formed of first yoke 34, movable element 32, and first stator 33. Furthermore, a magnetic path through which magnetic flux generated by second exciting coil 41 is allowed to pass is formed of second yoke 44, movable element 32, and second stator 43.

In an example of FIG. 12, as in the above-mentioned exemplary embodiment, first yoke 34 includes yoke upper plate 341, yoke lower plate 342, yoke lateral plate 343, and bush 344. On the other hand, second yoke 44 does not share a part of first yoke 34 (yoke lower plate 342 and bush 344) as the upper plate, but has upper plate 441, lower plate 442, and lateral plate 443, which are separated from first yoke 34.

In a configuration in which a part of first yoke 34 is used as a part of second yoke 44 (see FIGS. 7A and 7B), a part of the magnetic flux generated by second exciting coil 41 may enter first yoke 34 from around, and interfere with the magnetic flux generated by first exciting coil 31. On the contrary, the configuration shown in FIG. 12 can reduce entering of the magnetic flux generated by second exciting coil 41 from around into first yoke 34. Consequently, movable element 32 moves into the third position with smaller electric current. Furthermore, the magnetic path for the magnetic flux generated by first exciting coil 31, and the magnetic path for the magnetic flux generated by second exciting coil 41 can be designed without considering interference therebetween. As a result, designing of both the magnetic paths can be facilitated.

FIGS. 13A to 13E are sectional views each showing an example of shapes of movable element 32 and second stator 43 in accordance with the first exemplary embodiment. It is preferable that a facing area between movable element 32 and second stator 43 is larger than a facing area between movable element 32 and first stator 33. In other words, it is preferable that a contact area between movable element 32 and second stator 43 when movable element 32 is in the third position is larger than a contact area between movable element 32 and first stator 33 when movable element 32 is in the second position.

Figure 13A:
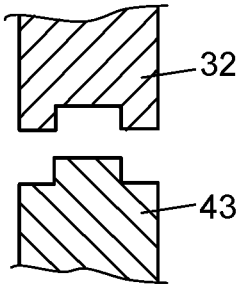
FIG. 13A is a sectional view showing an example of shapes of a movable element and a second stator in accordance with the first exemplary embodiment.
Figure 13B:
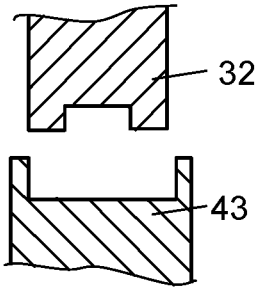
FIG. 13B is a sectional view showing an example of shapes of the movable element and the second stator in accordance with the first exemplary embodiment.
Figure 13C:
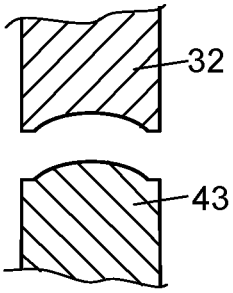
FIG. 13C is a sectional view showing an example of shapes of the movable element and the second stator in accordance with the first exemplary embodiment.
Figure 13D:
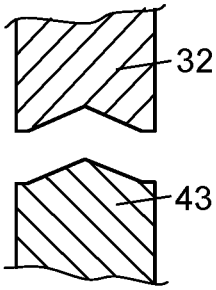
FIG. 13D is a sectional view showing an example of shapes of the movable element and the second stator in accordance with the first exemplary embodiment.

Specifically, as shown in FIGS. 13A, 13B, 13C, and 13D, when facing regions of movable element 32 and second stator 43 are each formed in a recess or a protrusion which are fitted into each other, the area where movable element 32 and second stator 43 face each other can be made larger. Herein, in the shapes of the recess and the protrusion, as shown in FIGS. 13A, 13C, and 13D, second stator 43 may be a protrusion, or as shown in FIG. 13B, movable element 32 may be a protrusion.

Figure 13E:
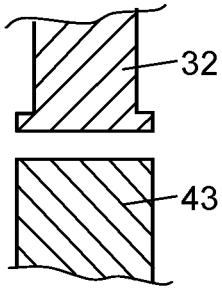
FIG. 13E is a sectional view showing an example of shapes of the movable element and the second stator in accordance with the first exemplary embodiment.

In addition, as shown in FIG. 13E, the facing area between movable element 32 and second stator 43 may be increased by making the outer diameter of second stator 43 larger than that of first stator 33, and by increasing the diameter at the end part (lower end part) on a second stator 43 side of movable element 32. Note here that FIGS. 13A to 13E are schematic views showing the shapes of movable element 32 and second stator 43. In the drawings, parts other than movable element 32 and second stator 43 are omitted.

With the above-mentioned configuration, in a state in which movable element 32 is located in the middle of first stator 33 and second stator 43, an attractive force acting on movable element 32 from second stator 43 is relatively larger than an attractive force acting on movable element 32 from first stator 33. Therefore, in tripping, the speed at which contact device 2 is opened is increased, electromagnetic relay 1 can rapidly disconnect the electric circuit (contact device 2) by using magnetic flux generated when an abnormal current flows.

FIGS. 14A to 14F are sectional views each showing an example of shapes of movable element 32 and first stator 33 in accordance with the first exemplary embodiment. As shown in FIGS. 14A to 14F, at least one of movable element 32 and first stator 33 may have a recess or a protrusion on a surface facing the other of movable element 32 and first stator 33. That is to say, when movable element 32 is in the second position, at least one of movable element 32 and first stator 33 may have a recess or a protrusion on a surface facing the other of movable element 32 and first stator 33 so as to prevent entire surfaces of movable element 32 and first stator 33 from being brought into contact with each other.

Figure 14A:
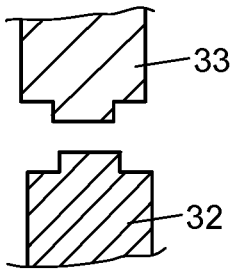
FIG. 14A is a sectional view showing an example of shapes of a movable element and a first stator in accordance with the first exemplary embodiment.
Figure 14B:
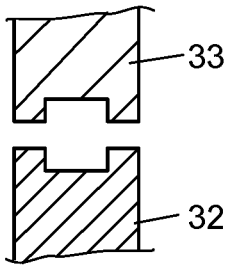
FIG. 14B is a sectional view showing an example of shapes of the movable element and the first stator in accordance with the first exemplary embodiment.
Figure 14C:
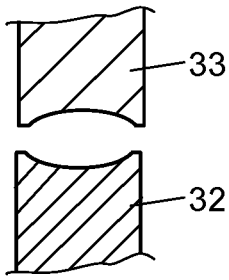
FIG. 14C is a sectional view showing an example of shapes of the movable element and the first stator in accordance with the first exemplary embodiment.
Figure 14D:
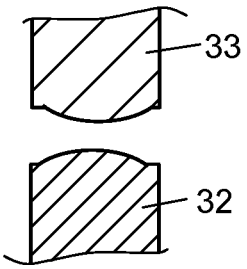
FIG. 14D is a sectional view showing an example of shapes of the movable element and the first stator in accordance with the first exemplary embodiment.
Figure 14E:
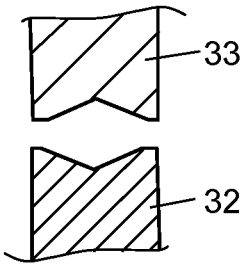
FIG. 14E is a sectional view showing an example of shapes of the movable element and the first stator in accordance with the first exemplary embodiment.
Figure 14F:
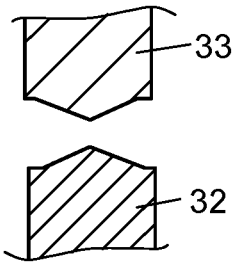
FIG. 14F is a sectional view showing an example of shapes of the movable element and the first stator in accordance with the first exemplary embodiment.

With this configuration, a clearance is generated between movable element 32 and first stator 33 when movable element 32 is in the second position. Herein, as shown in FIGS. 14A, 14D, and 14F, the center portion of the facing surface may have a protrusion, and as shown in FIGS. 14B, 14C, and 14E, the outer periphery of the facing surface may have a protrusion.

In FIGS. 14A to 14F, both movable element 32 and first stator 33 are provided with a recess or a protrusion, but at least one of movable element 32 and first stator 33 may be provided with a recess or a protrusion. That is to say, only movable element 32 or only first stator 33 may be provided with a recess or a protrusion. Note here that FIGS. 14A to 14F are schematic views each showing the shapes of movable element 32 and first stator 33. In the drawings, parts other than movable element 32 and first stator 33 are omitted.

With the above-mentioned configuration, in a state in which movable element 32 is in the second position, an attractive force acting on movable element 32 from first stator 33 becomes relatively small as compared with a case where a clearance by the recess and the protrusion are not provided. Therefore, an attractive force of movable element 32 necessary for tripping becomes smaller, trip device 4 can carry out tripping by a relatively small force. As a result, the speed at which contact device 2 is opened is increased, electromagnetic relay 1 can rapidly disconnect the electric circuit (contact device 2) by using the magnetic flux generated when an abnormal current flows.

Note here that the above-mentioned configurations described in the first exemplary embodiment can be appropriately combined.

Second Exemplary Embodiment

Figure 15:
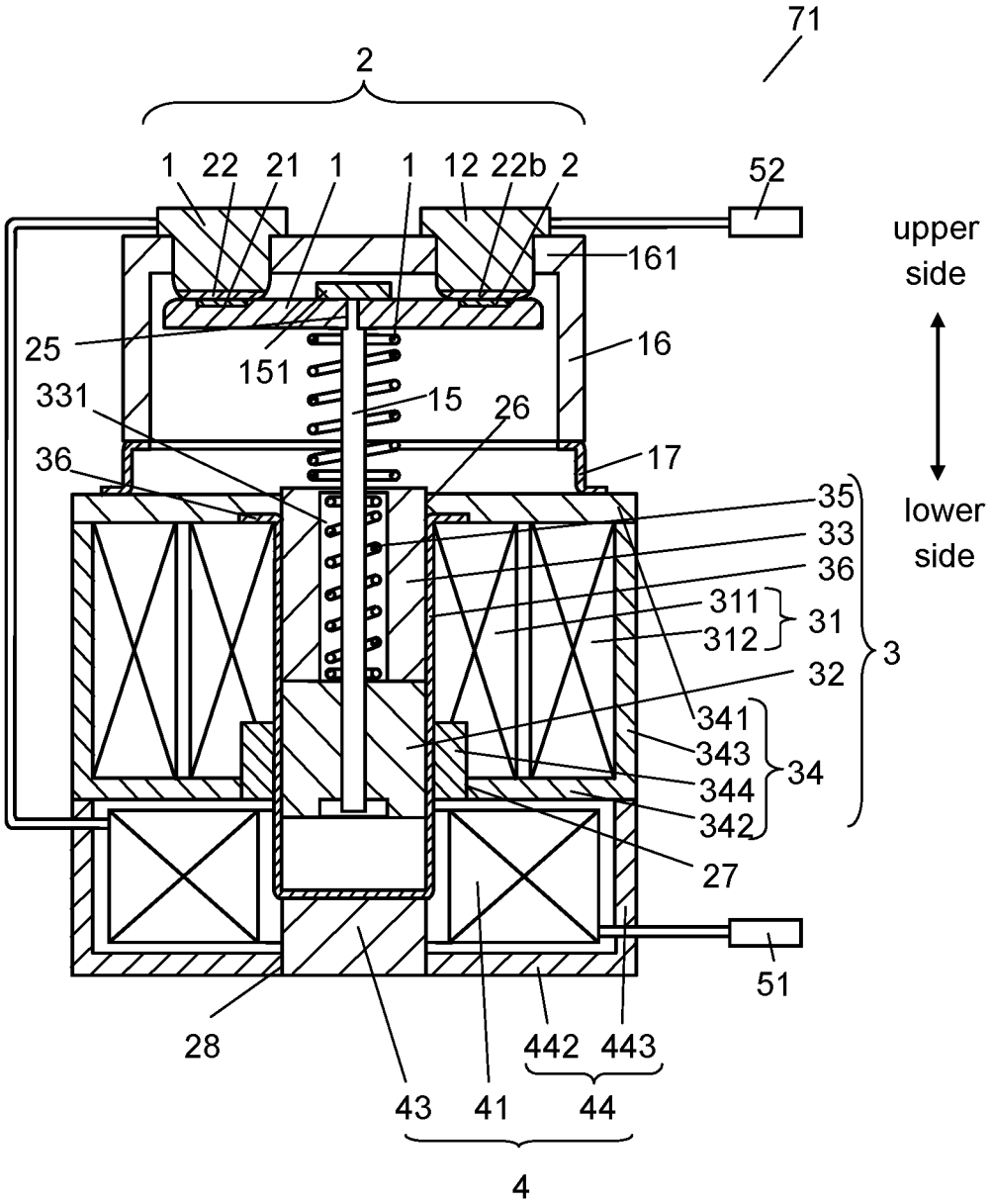
FIG. 15 is a sectional schematic view showing a principal part of an electromagnetic relay in accordance with a second exemplary embodiment.

FIG. 15 is a sectional schematic view showing a principal part of electromagnetic relay 71 in accordance with this exemplary embodiment. Electromagnetic relay 71 of this exemplary embodiment is different from electromagnetic relay 1 of the first exemplary embodiment in that first exciting coil 31 includes input coil 311 and holding coil 312 as shown in FIG. 15. Holding coil 312 is a coil having a smaller magnetic flux density than input coil 311 when the same amount of electric current flows. Hereinafter, the common reference numerals are given to the same configuration as in FIG. 1 and description thereof is omitted.

In an example of FIG. 15, input coil 311 and holding coil 312 are double-wound around the same axis such that holding coil 312 is wound over the outer periphery of input coil 311.

During the input period in which movable element 32 is moved from the first position to the second position, input coil 311 is energized. During the holding period in which movable element 32 is held in the second position, holding coil 312 is energized. That is to say, when contact device 2 of electromagnetic relay 71 is closed, electronic control unit 103 energizes input coil 311 for a predetermined input period. After the input period has passed, energization of input coil 311 is stopped and then the energization to that of holding coil 312 is switched.

Figure 16:
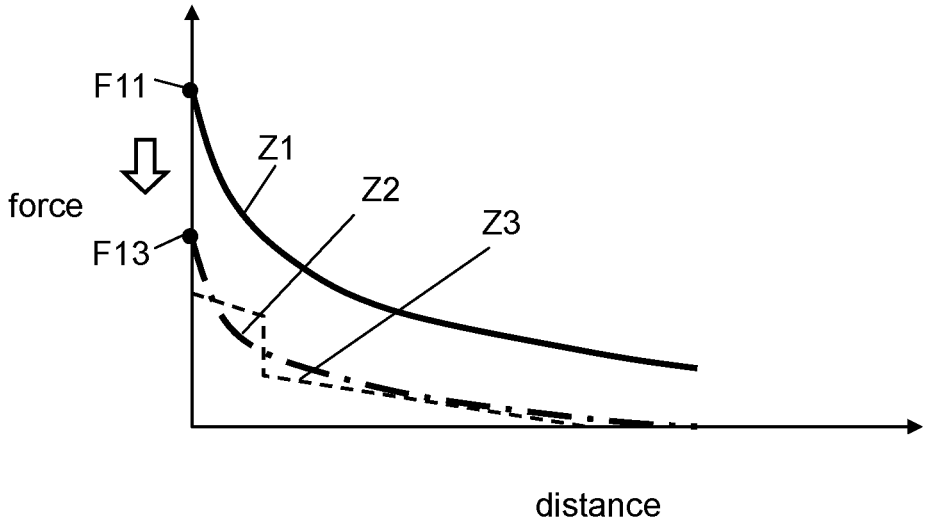
FIG. 16 is a graph showing forces acting on a movable element of the electromagnetic relay in accordance with the second exemplary embodiment.

FIG. 16 is a graph showing forces acting on movable element 32 of electromagnetic relay 71 in accordance with this exemplary embodiment. In FIG. 16, the abscissa represents a distance between movable element 32 and first stator 33. The ordinate represents a force. FIG. 16 shows attractive force Z1, attractive force Z2, and spring force Z3 acting on movable element 32. Attractive force Z1 is an attractive force acting on movable element 32 from first stator 33 at the time of energization of input coil 311. Attractive force Z2 is an attractive force acting on movable element 32 from first stator 33 at the time of energization of holding coil 312. As shown in FIG. 16, the larger the distance between movable element 32 and first stator 33 is, the smaller the attractive force acting on movable element 32 from first stator 33 is. Attractive force Z1 acting on movable element 32 from first stator 33 corresponds to first force F1 shown in FIG. 5. Spring force Z3 acting on movable element 32 corresponds to second force F2 shown in FIG. 5.

Herein, in order to close contact device 2 in an open state, attractive force Z1 acting upward on movable element 32 needs to exceed spring force Z3 acting downward on movable element 32. Since attractive force Z2 acting on movable element 32 at the time of energization of holding coil 312 (holding period) is less than spring force Z3 in some periods, electromagnetic relay 71 cannot close contact device 2 in an open state even when holding coil 312 is energized. On the contrary, since input coil 311 generates larger magnetic flux density than holding coil 312, attractive force Z1 acting on movable element 32 at the time of energization (input period) of input coil 311 exceeds spring force Z3 in the entire section. Therefore, when input coil 311 is energized, contact device 2 in an open state is closed.

On the other hand, in electromagnetic relay 71, when contact device 2 becomes a closed state, and the input period is switched to the holding period, an attractive force acting on movable element 32 is reduced from "F11" of "Z1" to "F13" of "Z2". However, attractive force Z2 (F13) in the holding period is set to exceed at least spring force Z3 because movable element 32 is required to be held in the second position. At this time, since an attractive force (third force F3 shown in FIG. 5) necessary for tripping, between movable element 32 and second stator 43, may be larger than a value obtained by subtracting a spring force $\alpha$ from F13, it is smaller than an attractive force (value obtained by subtracting a spring force $\alpha$ from F11) in the input period. Note here that the spring force $\alpha$ is a spring force when movable element 32 is in the second position, and its value is the same in both the input period and the holding period.

According to the configuration of this exemplary embodiment described above, in the holding period rather than the input period, that is to say, in a state in which movable element 32 is in the second position, an attractive force acting between first stator 33 and movable element 32 is reduced. Consequently, it is advantageous that an attractive force necessary for tripping can be made smaller. In addition, power consumption of holding coil 312 can be suppressed to be smaller than that of input coil 311. Consequently, as compared with the input period, power consumption in the holding period can be suppressed to be small.

Furthermore, as another example of this exemplary embodiment, as mentioned above, a configuration in which an attractive force acting between first stator 33 and movable element 32 is smaller in the holding period than in the input period can be achieved by a single first exciting coil 31.

In this example, electromagnet device 3 can switch the amount of electric current flowing through first exciting coil 31 between an input electric current and a holding electric current that is smaller than the input electric current. In addition, electromagnet device 3 is configured so that the input electric current is supplied to first exciting coil 31 in the input period, and the holding electric current is supplied to first exciting coil 31 in the holding period. The input period herein denotes a period in which the movable element 32 is allowed to move from the first position to the second position as mentioned above. The holding period is a period in which the movable element 32 is held in the second position.

Specifically, for example, electronic control unit 103 (see FIG. 4) switches an electric current so that the input electric current is allowed to flow in first exciting coil 31 only for a predetermined input period when contact device 2 is closed, and the holding electric current is allowed to flow in first exciting coil 31 when the input period has passed.

With this configuration, in the holding period rather than the input period, an attractive force acting between first stator 33 and movable element 32 becomes smaller in a state in which movable element 32 is in the second position. Consequently, it is advantageous that an attractive force necessary for tripping can be made smaller. In addition, since power consumption of first exciting coil 31 can be suppressed to be smaller in the holding period than in the input period, power consumption in the holding period can be suppressed to be small. Furthermore, since first exciting coil 31 may be a single coil, the cost and the size can be reduced as compared with the case where a plurality of coils is used as first exciting coil 31.

Third Exemplary Embodiment

Figure 17:
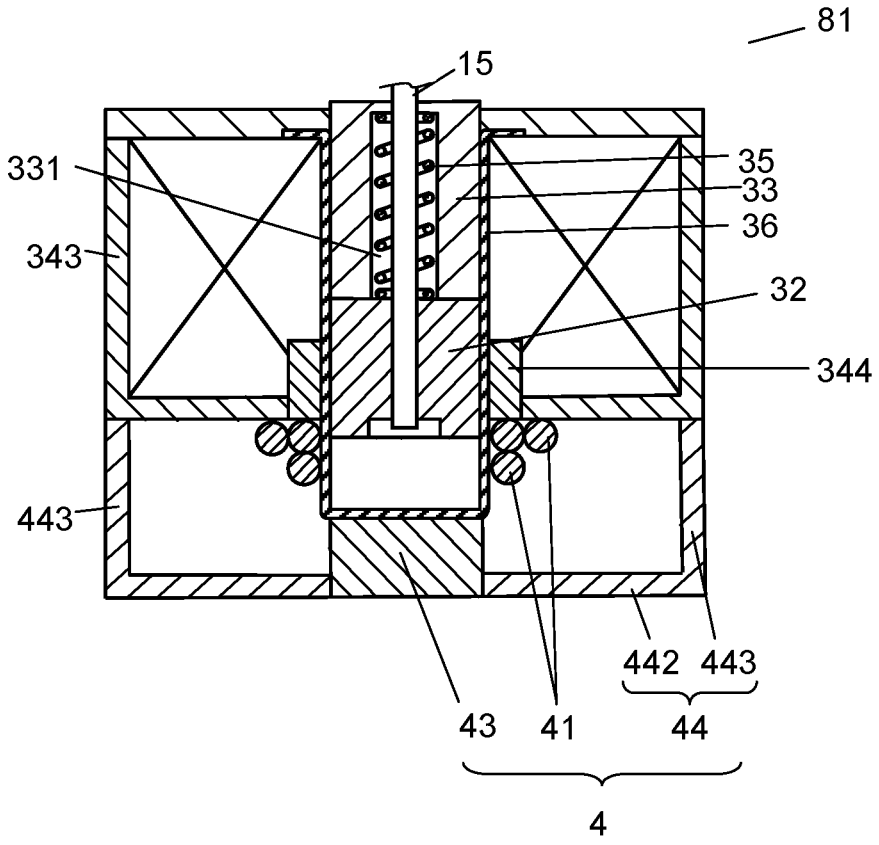
FIG. 17 is a schematic sectional view showing a principal part of an electromagnetic relay in accordance with a third exemplary embodiment.

FIG. 17 is a schematic sectional view showing a principal part of electromagnetic relay 81 in accordance with this exemplary embodiment. In electromagnetic relay 81, as shown in FIG. 17, second exciting coil 41 is wound to be overlapped so that the number of windings in a part in one direction (vertical direction) of trip device 4 is larger than that of the other region. That is to say, in a part of the vertical direction of trip device 4, second exciting coil 41 is wound to be overlapped in the direction perpendicular to the vertical direction. That is to say, second exciting coil 41 is wound to be overlapped so that the number of windings is larger at least in a part than in the other part. Since the other configurations and functions are the same as those in the first exemplary embodiment, the common reference numerals are given to the same configurations as in the first exemplary embodiment.

As shown in FIG. 17, in second exciting coil 41, coil wire (copper wire) is wound around the outer periphery of cylindrical body 36 in space surrounded by second yoke 44. Herein, the number of turns (the number of windings) of second exciting coil 41 is three turns, and two turns of the three are wound along the lower surface of yoke lower plate 342. That is to say, second exciting coil 41 is wound to be overlapped in a direction perpendicular to one direction (diameter direction of cylindrical body 36) in an upper end part in the one direction (vertical direction) of trip device 4. As a result, the number of windings is larger in the upper end part than in the other region.

Magnetic flux generated in space in the inner side of second exciting coil 41 at the time of energization of second exciting coil 41 is concentrated on a region in which the number of windings of second exciting coil 41 is larger than the other region in one direction (vertical direction). Therefore, the magnetic flux density in space in the inner side of second exciting coil 41 is maximum in a region in which the number of windings of second exciting coil 41 is larger than the other region in one direction (vertical direction). Consequently, magnetic flux passing through movable element 32 in the second position is increased in tripping as compared with the case where the number of windings of second exciting coil 41 is uniform throughout the entire part in one direction (vertical direction). As a result, an attractive force acting on movable element 32 becomes larger.

In more detail, forces acting on movable element 32 when trip device 4 is operated are roughly divided into the following two types. The first type of force is an attractive force (third force F3) acting on movable element 32 from second stator 43, and the second type of force is a force acting on movable element 32 by magnetic flux generated in the space. Third force F3 among these attractive forces acting on movable element 32 from second stator 43 is inversely proportional to a square of a clearance (gap) between movable element 32 and second stator 43 as represented by the above-mentioned Mathematical formula 1 (Math. 1). At the starting time of tripping, movable element 32 is in the second position, the gap between movable element 32 and second stator 43 is relatively large, and therefore the second type of force is more dominant than the first type of force (third force F3) as the force acting on movable element 32.

Then, the second type of force becomes larger as the magnetic flux density in movable element 32 becomes larger. Therefore, as mentioned above, when magnetic flux is concentrated on a part of space in the inner side of second exciting coil 41, the second type of force is also increased. As a result, the speed at which contact device 2 is opened in tripping is increased, electromagnetic relay 81 can rapidly disconnect the electric circuit (contact device 2) by using magnetic flux generated when an abnormal current flows.

Figure 18:
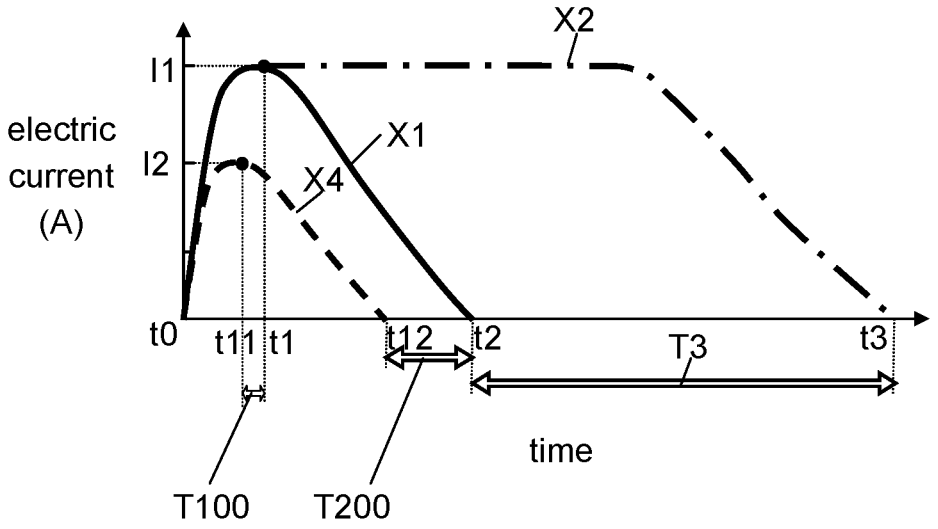
FIG. 18 is a graph to illustrate an operation of an electromagnetic relay in accordance with the third exemplary embodiment.

Next, electromagnetic relay 81 is provided with second exciting coil 41 and therefore can promptly disconnect the electric circuit from the closed state of contact device 2 in response to an abnormal current. This point briefly is described with reference to FIG. 18. FIG. 18 is a graph to illustrate an operation of electromagnetic relay 81 in accordance with this exemplary embodiment. In FIG. 18, the abscissa represents time, and the ordinate represents an electric current. FIG. 18 shows a load current flowing in the electric circuit (contact device 2) between battery 101 (see FIG. 4) and load 102. It is assumed that load 102 is short-circuited at time t0. In FIG. 18, a load current X1 shows a load current in the case where electromagnetic relay 1 of the first exemplary embodiment is used. Load current X2 shows a load current in the case where a conventional electromagnetic relay without having trip device 4 is used.

Load current X4 shows a load current in a case where electromagnetic relay 81 of this exemplary embodiment is used. In FIG. 18, a load current by chattering of contact device 2 is omitted.

Since the case where electromagnetic relay 1 of the first exemplary embodiment is used and the case where trip device 4 is not provided are the same as described in the first exemplary embodiment, the description therefor is omitted herein.

On the other hand, electromagnetic relay 81 of this exemplary embodiment is short-circuited at time t0, and immediately makes contact device 2 open by trip device 4, when load current X4 increases and reaches prescribed value I2 at time W. Herein, when the same amount of load current flows in second exciting coil 41, an attractive force acting on movable element 32 becomes larger in electromagnetic relay 81 than in electromagnetic relay 1. Therefore, a load current (prescribed value) to start tripping is reduced. Therefore, electromagnetic relay 81 starts tripping at time t11 earlier by time period T100 from time t1 at which load current X1 of electromagnetic relay 1 reaches prescribed value I1.

In addition, an attractive force acting on movable element 32 is larger in electromagnetic relay 81 than in electromagnetic relay 1. Therefore, the speed at which contact device 2 is opened is increased. As a result, electromagnetic relay 81 can disconnect load current X4 at time t12 earlier by time period T200 from time t2 at which load current X1 of electromagnetic relay 1 is interrupted.

Furthermore, it is also advantageous that electromagnetic relay 81 can further suppress an increase of a load current. That is to say, electromagnetic relay 81 can shorten the time from the time at which short-circuit occurs to the time at which load current X4 is interrupted. Therefore, even if overshooting occurs in load current X4, load current X4 can be interrupted before it increases to the short-circuit current. Note here that the short-circuit current herein denotes an electric current that is, for example, about several times to several tens of times larger than the rated current.

According to the above-described electromagnetic relay 81 of this exemplary embodiment, trip device 4 can attract movable element 32 by the magnetic flux generated by second exciting coil 41 by not less than the prescribed value of abnormal current flowing through contact device 2, and rapidly move movable element 32 to the third position. Therefore, electromagnetic relay 81 can turn off contact device 2 more promptly when an abnormal current such as an overcurrent and a short-circuit current flows into contact device 2.

Note here that in FIG. 17, at least a part of second exciting coil 41 is disposed such that it is overlapped with movable element 32 located in the second position in the direction perpendicular to the vertical direction. Although such a configuration can also have the above-mentioned effect, more remarkably effect can be achieved in a case where at least a part of second exciting coil 41 is disposed such that it is not overlapped with movable element 32 located in the second position in the direction perpendicular to the vertical direction. That is to say, in a case where at least a part of second exciting coil 41 is disposed such that it is not overlapped with movable element 32 in the second position in the direction perpendicular to the vertical direction, most of the above-mentioned second type of force acts in the direction (downward) for moving movable element 32 toward the third position. Therefore, electromagnetic relay 81 can promptly turn off contact device 2 when an abnormal current such as an overcurrent and a short-circuit current flows in contact device 2.

Furthermore, in electromagnetic relay 81, second exciting coil 41 may be wound to be overlapped so that the number of windings is larger in a part than in the other regions, in one direction (vertical direction) of trip device 4 in the direction perpendicular to the one direction. Therefore, as shown in FIG. 17, second exciting coil 41 is wound to be overlapped not necessarily in the direction perpendicular to the one direction (diameter direction of cylindrical body 36) but in any other parts in the one in the diameter direction of cylindrical body 36.

For example, second exciting coil 41 may be wound to be overlapped in the direction perpendicular to one direction (diameter direction of cylindrical body 36) in the center portion or the bottom portion in the one direction (vertical direction) of trip device 4. In addition, the number of windings of second exciting coil 41 can be appropriately changed.

Furthermore, second exciting coil 41 may be wound to be overlapped in a part in one direction (vertical direction) in trip device 4, and the number of windings of second exciting coil 41 may be 0 (zero) in the other region. That is to say, second exciting coil 41 may be wound only in a part in one direction of trip device 4. Then, in a part in one direction of trip device 4, second exciting coil 41 may be wound separately in a plurality of stages. In this case, the number of windings of second exciting coil 41 in stages of the plurality of stages may be the same. That is to say, for example, when the number of turns (the number of windings) of second exciting coil 41 is four turns, second exciting coil 41 is preferably wound such that it is separated into three turns and one turn, but may be separated into two turns each.

That is to say, electromagnetic relay 81 of this exemplary embodiment may have a configuration in which second exciting coil 41 is wound to be overlapped in a direction perpendicular to one direction so that the number of windings is larger than in a part in the one direction of trip device 4 other than the other region. Thus, electromagnetic relay 81 can move movable contact 32 more rapidly as compared with electromagnetic relay 1. Accordingly, it is possible to appropriately change whether or not second exciting coil 41 is wound in the above-mentioned other region, or how second exciting coil 41 is wound in the above-mentioned part.

Note here that, the configuration described in this exemplary embodiment may be appropriately combined with the second exemplary embodiment not only with the first exemplary embodiment.

Fourth Exemplary Embodiment

Figure 19:
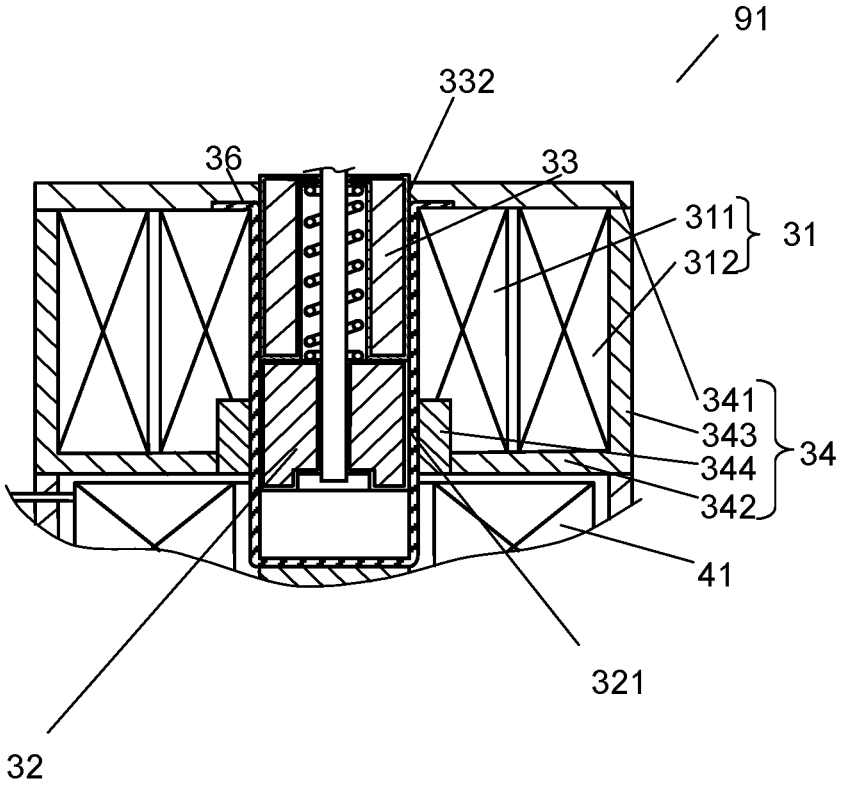
FIG. 19 is a schematic sectional view showing a principal part of an electromagnetic relay in accordance with a fourth exemplary embodiment.
Figure 20A:
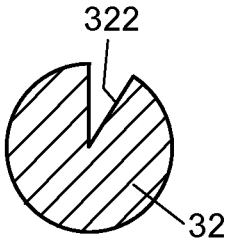
FIG. 20A is a schematic view showing an example of a cross-sectional shape of a movable element in accordance with the fourth exemplary embodiment.
Figure 20B:
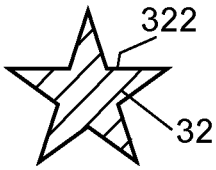
FIG. 20B is a schematic view showing an example of the cross-sectional shape of the movable element in accordance with the fourth exemplary embodiment.
Figure 20C:
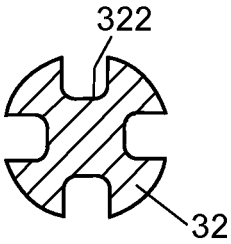
FIG. 20C is a schematic view showing an example of the cross-sectional shape of the movable element in accordance with the fourth exemplary embodiment.
Figure 20D:
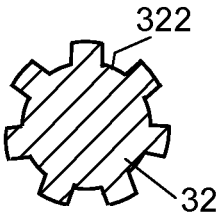
FIG. 20D is a schematic view showing an example of the cross-sectional shape of the movable element in accordance with the fourth exemplary embodiment.
Figure 20E:
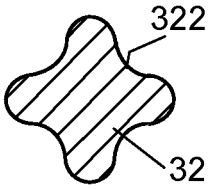
FIG. 20E is a schematic view showing an example of the cross-sectional shape of the movable element in accordance with the fourth exemplary embodiment.

FIG. 19 is a schematic sectional view showing a principal part of electromagnetic relay 91 in accordance with this exemplary embodiment. Electromagnetic relay 91 employs a configuration in which occurrence of an eddy current is suppressed in at least a part of a first magnetic path member forming a magnetic path through which magnetic flux generated by first exciting coil 31 is allowed to pass and a second magnetic path member forming a magnetic path through which magnetic flux generated by second exciting coil 41 is allowed to pass. The other configurations and functions are the same as those of first exemplary embodiment, and therefore the same reference numerals are given to the same configurations of the first exemplary embodiment, and the description therefor is omitted herein.

The first magnetic path member includes movable element 32, first stator 33, and first yoke 34. Furthermore, first yoke 34 includes yoke upper plate 341, yoke lower plate 342, yoke lateral plate 343, and bush 344. Furthermore, the second magnetic path member includes movable element 32, second stator 43, and second yoke 44. Second yoke 44 includes yoke lower plate 342, bush 344, lower plate 442, and lateral plate 443.

At least a part of the first magnetic path member and the second magnetic path member is made of material having higher electrical resistivity than that of fixed contacts 22*a* and 22*b* (see FIG. 1). That is to say, at least one of movable element 32, first stator 33, first yoke 34, second stator 43, and second yoke 44 is made of material having higher electrical resistivity than that of fixed contacts 22*a* and 22*b*.

Specifically, at least one of movable element 32 and first stator 33 is made of material having higher electrical resistivity than that of fixed contacts 22*a* and 22*b*. Herein, examples of the material for movable element 32 and first stator 33 include electromagnetic SUS (stainless steel), magnetic powder body (magnetic powder), and ferrite. When the magnetic powder is used, movable element 32 and first stator 33 are formed by mixing insulating material such as magnetic powder and synthetic resin, molding thereof, and heat-curing thereof.

By using material having higher electrical resistivity than that of fixed contacts 22*a* and 22*b* for at least a part of the first magnetic path member and the second magnetic path member, occurrence of the eddy current can be suppressed.

Furthermore, as shown in FIG. 19, the surface of movable element 32 is covered with covering member 321, and the surface of first stator 33 is covered with covering member 332. Herein, as covering members 321 and 332, it is desirable to use material having elasticity or plasticity, for example, synthetic resin.

In this way, when the surfaces of movable element 32 and first stator 33 are covered (coated) with covering members 321 and 332, shock generated when movable element 32 collides with first stator 33 can be mitigated (buffered). As a result, it is possible to avoid generation of distortion and the like of movable element 32 and first stator 33 due to shock in collision. This leads to improvement of reliability of electromagnetic relay 91. In particular, when movable element 32 and first stator 33 are made of material having higher electrical resistivity as compared with that of fixed contacts 22*a* and 22*b*, the strength of movable element 32 and first stator 33 is easily reduced. Thus, movable element 32 and first stator 33 can be reinforced by covering members 321 and 332.

Note here that a surface of at least one of movable element 32 and first stator 33 may be covered with a covering member. Both surfaces of movable element 32 and first stator 33 are not necessarily covered with the covering member.

According to the configuration of this exemplary embodiment, the generation of an eddy current can be suppressed in at least a part of the first magnetic path member forming the magnetic path through which magnetic flux generated by first exciting coil 31 is allowed to pass and the second magnetic path member forming the magnetic path through which magnetic flux generated by second exciting coil 41 is allowed to pass. That is to say, electromagnetic relay 91 of this exemplary embodiment can suppress an eddy current of the first magnetic path member and the second magnetic path member at the time of change (rising time) of electric current flowing in first exciting coil 31 or second exciting coil 41. When such an eddy current generates new magnetic flux, the new magnetic flux repels the magnetic flux generated by first exciting coil 31 or second exciting coil 41. As a result, an attractive force acting on movable element 32 may be reduced. In this exemplary embodiment, by suppressing the generation of eddy current, reduction of the attractive force acting on movable element 32 can be suppressed.

FIGS. 20A to 20E are schematic views each showing an example of a cross-sectional shape of movable element 32 in accordance with this exemplary embodiment. FIGS. 20A to 20E show cross-sectional shapes of movable element 32 in a top view, respectively. In FIGS. 20A to 20E, in the direction in which the eddy current flows in at least a part of the first magnetic path member and the second magnetic path member, a place having higher electrical resistance is formed. That is to say, a cut-away portion is formed in at least one of movable element 32, first stator 33, first yoke 34, second stator 43, and second yoke 44 in a part of the outer periphery of the cross-section perpendicular to the first magnetic flux or the second magnetic flux. Specifically, as shown in FIGS. 20A to 20E, a cut-away portion is formed in a part of the outer periphery of movable element 32. In detail, a cut-away portion 322 is formed in a part of the outer periphery of the cross-section of movable element 32 perpendicular to the magnetic flux. When cut-away portion 322 is provided, since the electrical resistance in the direction in which an eddy current flows is increased, the occurrence of the eddy current is suppressed. In particular, an electric current density in the vicinity of the conductor is relatively higher due to the skin effect. Therefore, by providing cut-away portion 322 in the outer periphery, the occurrence of the eddy current flowing on the surface of movable element 32 as a part of the first magnetic path member and the second magnetic path member is suppressed.

Figure 21:
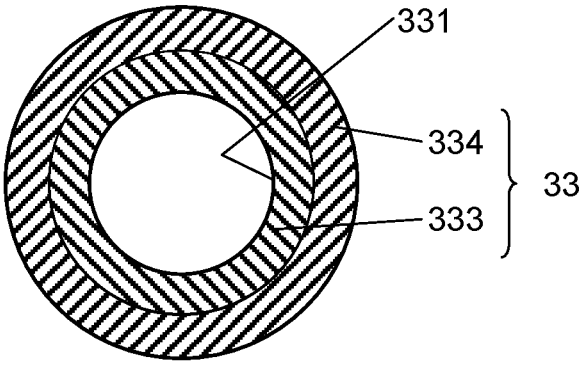
FIG. 21 is a schematic view showing an example of a cross-sectional shape of a first stator in accordance with the fourth exemplary embodiment.

FIG. 21 is a schematic view showing an example of a cross-sectional shape of first stator 33 in accordance with this exemplary embodiment. Note here that FIG. 21 shows a cross-sectional shape of first stator 33 seen in the bottom view. In FIG. 21, in the direction in which the eddy current flows in at least a part of the first magnetic path member and the second magnetic path member, a place having higher electrical resistance is formed. That is to say, a plurality of layers are laminated in the direction perpendicular to the first magnetic flux or the second magnetic flux of at least one of movable element 32, first stator 33, first yoke 34, second stator 43, and second yoke 44.

Specifically, first stator 33 includes a plurality of layers. In detail, a plurality of layers 333 and 334 are laminated in the cross-section of first stator 33 perpendicular to the magnetic flux.

In the example of FIG. 21, first stator 33 has a laminated structure in which a plurality of layers 333 and 334 are laminated in the diameter direction. Herein, the plurality of layers 333 and 334 may be made of the same material or different material. Furthermore, the direction in which the plurality of layers 333 and 334 are laminated is not necessarily limited to the diameter direction of first stator 33, but may be a direction in which at least a part of an eddy current flows in the first magnetic path member and the second magnetic path member.

According to this exemplary embodiment, when at least a part of the first magnetic path member and the second magnetic path member is formed in a laminated structure, electrical resistance in the direction in which the eddy current flows is increased. Consequently, generation of the eddy current can be suppressed. Note here that the laminated structure is not limited to a two-layered structure as shown in FIG. 21, but may be a three-layered structure.

Note here that, the configuration described in this exemplary embodiment may be appropriately combined with the second and third exemplary embodiments not only with the first exemplary embodiment.

Each of the above-mentioned exemplary embodiments shows an example of a case in which movable element 32 is located in the first position in an open state of contact device 2 in which trip device 4 is not operated, and movable element 32 is located in the third position that is different from the first position when trip device 4 is operated. However, the first position and the third position may be the same as each other. That is to say, the third position is used as the first position, and movable element 32 may be in the third position at the time of non-energization of first exciting coil 31. In this configuration, movable element 32 is in the third position in both the open state of contact device 2 in which trip device 4 is not operated and the open state of contact device 2 in which trip device 4 is operated.

Furthermore, in the above-mentioned exemplary embodiments, similar to second stator 43, second yoke 44 is not essential component and it can be appropriately omitted. Herein, second yokes 44 of each of electromagnetic relays 1, 61, and 63 include lower plate 442 and lateral plate 443. Furthermore, second yoke 44 of electromagnetic relay 65 includes upper plate 441, lower plate 442 and lateral plate 443.

Furthermore, in this exemplary embodiment, a cross-sectional shape of the coil wire (copper wire) used in first exciting coil 31 and second exciting coil 41 is made to be a circular shape. However, a cross-sectional shape of the coil wire (copper wire) used in first exciting coil 31 and second exciting coil 41 is not necessarily limited to a circular shape, but may be, for example, a sectional polygonal shape.

Figure 22A:
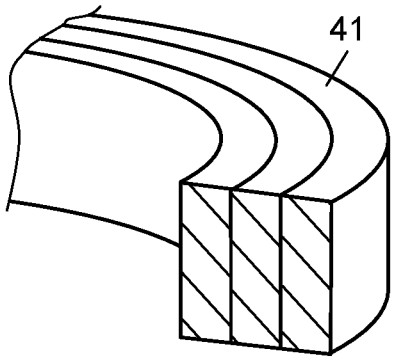
FIG. 22A is a schematic view showing an example of a second exciting coil in accordance with this exemplary embodiment.
Figure 22B:
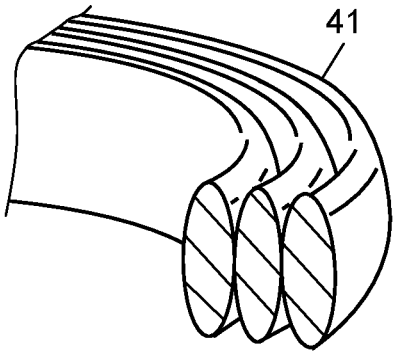
FIG. 22B is a schematic view showing an example of a second exciting coil in accordance with this exemplary embodiment.
Figure 23:
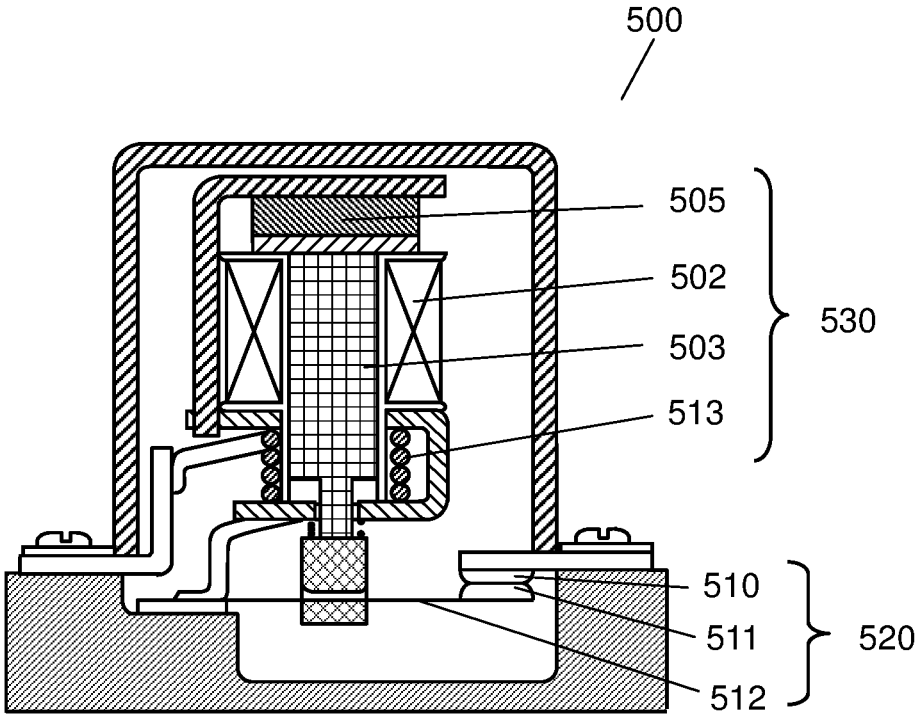
FIG. 23 Prior Art
FIG. 23 is a sectional schematic view of a conventional electromagnetic relay.

FIGS. 22A and 22B are schematic views showing an example of second exciting coil 41 in this exemplary embodiment. FIG. 22A shows an example in which a sectional rectangular-shaped flat wire is used for second exciting coil 41. FIG. 22B is shows an example in which a sectional elliptical wire rod is used for second exciting coil 41. According to this configuration, since the density of the coil wire of second exciting coil 41 is increased, if the number of windings is the same, the size is further reduced. Note here that FIGS. 22A and 22B show examples of the shapes of second exciting coil 41, but the shape of first exciting coil 31 may be the shapes shown in FIGS. 22A and 22B.

As mentioned above, in this exemplary embodiment, a contact device, an electromagnet device, and a trip device are arranged in one direction, and the trip device is disposed on the opposite side to the contact device with respect to the electromagnet device. When an abnormal current such as an overcurrent and a short-circuit current flows in the contact device, the contact device can be turned off. With this configuration, components such as a movable element are not required to be designed for exclusive use.

INDUSTRIAL APPLICABILITY

An electromagnetic relay can turn off a contact device when an abnormal current flows, and is therefore useful for controlling electronic apparatuses and devices, and the like.

The invention claimed is:

1. An electromagnetic relay comprising:

an electromagnet device including:

a first stator;

a movable element disposed facing the first stator; and a first exciting coil wound around at least a part of the first stator, wherein when the first exciting coil is energized, the electromagnet device attracts the movable element to the first stator by first magnetic flux generated by the first exciting coil, and moves the movable element from a first position to a second position;

a contact device including:

a movable contact disposed on an opposite side to the movable element with respect to the first stator, and linked to the movable element; and a fixed contact disposed facing the movable contact; and a trip device including a second exciting coil coupled to the contact device, and disposed on an opposite side to the contact device with respect to the electromagnet device, wherein when not less than a prescribed value of electric current flows in the contact device in a state in which the movable element is in the second position, the trip device moves the movable element to a third position by a second magnetic flux generated by the second exciting coil, wherein when the movable element is in the first position and the third position, the movable contact and the fixed contact are away from each other to form an open state, and when the movable element is in the second position, the movable contact and the fixed contact are brought into contact with each other to form a closed state.

2. The electromagnetic relay of claim 1, wherein the trip device includes a second stator disposed on an opposite side to the first stator with respect to the movable element, and when not less than the prescribed value of electric current flows in the contact device, the second stator attracts the movable element by the second magnetic flux generated by the second exciting coil, and moves the movable element to the third position.

3. The electromagnetic relay of claim 2, wherein a facing area between the movable element and the second stator is larger than a facing area between the movable element and the first stator.

4. The electromagnetic relay of claim 2, wherein the first stator is a cylindrical fixed iron core, the second stator is a columnar fixed iron core, and an outer diameter of the first stator is smaller than an outer diameter of the second stator.

5. The electromagnetic relay of claim 2, further comprising a first yoke, the first yoke, together with the movable element and the first stator, forming a first magnetic path through which the first magnetic flux generated by the first exciting coil is allowed to pass, wherein a shortest distance between the first yoke and the second stator is longer than a shortest distance between the movable element in the second position and the second stator.

6. The electromagnetic relay of claim 2, further comprising:

a first yoke, the first yoke, together with the movable element and the first stator, forming a first magnetic path through which the first magnetic flux generated by the first exciting coil is allowed to pass, and a second yoke, the second yoke, together with the movable element and the second stator, forming a second magnetic path through which the second magnetic flux generated by the second exciting coil is allowed to pass.

7. The electromagnetic relay of claim 6, wherein the first yoke and the second yoke are provided as separate bodies.

8. The electromagnetic relay of claim 6, wherein a minimum value of a cross-sectional area of the first magnetic path is smaller than a minimum value of a cross-sectional area of the second magnetic path.

9. The electromagnetic relay of claim 6, wherein at least one of the movable element, the first stator, the first yoke, the second stator, and the second yoke is made of material having larger electrical resistivity than that of the fixed contact.

10. The electromagnetic relay of claim 6, wherein a cut-away portion is formed in at least one of the movable element, the first stator, the first yoke, the second stator, and the second yoke, at a part of an outer periphery of the cross-section perpendicular to the first magnetic flux or the second magnetic flux.

11. The electromagnetic relay of claim 6, wherein a plurality of layers is laminated in a direction perpendicular to the first magnetic flux or the second magnetic flux of at least one of the movable element, the first stator, the first yoke, the second stator, and the second yoke.

12. The electromagnetic relay of claim 1, wherein the contact device includes a contact pressure spring for pressing the movable contact against the fixed contact.

13. The electromagnetic relay of claim 12, wherein in a state in which the movable element is in the second position, the prescribed value is set to be smaller than a value of electric current flowing in the contact device, when an electromagnetic repulsive force generated in a direction in which the movable contact is separated from the fixed contact is balanced with a spring force of the contact pressure spring.

14. The electromagnetic relay of claim 1, wherein in a state in which the movable element is in the second position, the first exciting coil generates the first magnetic flux passing through the first stator and the movable element, and the second exciting coil generates a third magnetic flux in a reverse direction to the direction of the first magnetic flux, between the first stator and the movable element.

15. The electromagnetic relay of claim 1, wherein in a state in which the movable element is in the second position, the first exciting coil generates the first magnetic flux passing through the first stator and the movable element, and the second exciting coil generates a fourth magnetic flux in the same direction as the direction of the first magnetic flux, between the first stator and the movable element.

16. The electromagnetic relay of claim 1, wherein at least a part of the second exciting coil is disposed in a periphery of at least a part of the movable element in the second position.

17. The electromagnetic relay of claim 1, wherein the number of windings of the second exciting coil is not more than one turn.

18. The electromagnetic relay of claim 1, wherein an axis around which the first exciting coil is wound and an axis around which the second exciting coil is wound are identical to each other, and the second exciting coil is disposed in such a manner that at least a part of the second exciting coil overlaps with the first exciting coil.

19. The electromagnetic relay of claim 1, further comprising an adjusting member formed of non-magnetic material, between the movable element and the first stator.

20. The electromagnetic relay of claim 1, wherein at least one of the movable element and the first stator has a recess or a protrusion on a surface facing the other of the movable element and the first stator so as to prevent an entire part of the surface of the movable element and an entire part of the surface of the first stator from being brought into contact with each other when the movable element is in the second position.

21. The electromagnetic relay of claim 1, wherein the first exciting coil includes an input coil, and a holding coil having a smaller density of magnetic flux generated when the same amount of electric current flows as in the input coil, and the input coil is energized during an input period in which the movable element moves from the first position to the second position, and the holding coil is energized during a holding period in which the movable element is held in the second position.

22. The electromagnetic relay of claim 1, wherein an electric current flowing in the first exciting coil can be switched between an input electric current and a holding electric current smaller than the input electric current, and wherein the input electric current is supplied to the first exciting coil during an input period in which the movable element is moved from the first position to the second position, and the holding electric current is supplied to the first exciting coil during a holding period in which the movable element is held in the second position.

23. The electromagnetic relay of claim 1, wherein the second exciting coil is wound to be overlapped so that the number of windings at least in one part is larger than in other parts.

24. The electromagnetic relay of claim 1, wherein the movable element and the first stator are made of material having larger electrical resistivity than that of the fixed contact.

25. The electromagnetic relay of claim 1, wherein a surface of at least one of the movable element and the first stator is covered with a covering member.

26. The electromagnetic relay of claim 1, wherein a cut-away portion is formed in a part of an outer periphery of the movable element.

27. The electromagnetic relay of claim 1, wherein the first stator has a plurality of layers.

* * * * *